US008056874B2

(12) United States Patent
Goodwin et al.

(10) Patent No.: US 8,056,874 B2
(45) Date of Patent: Nov. 15, 2011

(54) MOUNTING AND POSITIONING APPARATUS FOR INCREASED USER INDEPENDENCE

(75) Inventors: Dianne M. Goodwin, St. Paul, MN (US); Nicholas K. Lee, Minneapolis, MN (US); Lisa E. Petersson, Minneapolis, MN (US); Sherry M. Rovig, Duluth, MN (US); Andrew L. VonDuyke, Minnetonka, MN (US)

(73) Assignee: Blue Sky Designs, Inc., Minneapolis, MN (US)

( * ) Notice: Subject to any disclaimer, the term of this patent is extended or adjusted under 35 U.S.C. 154(b) by 1020 days.

(21) Appl. No.: 11/760,086

(22) Filed: Jun. 8, 2007

(65) Prior Publication Data

US 2008/0302938 A1 Dec. 11, 2008

(51) Int. Cl.
*E04G 3/00* (2006.01)

(52) U.S. Cl. ..... 248/276.1; 248/284.1; 403/52; 403/112

(58) Field of Classification Search ..... 248/179.1, 248/180.1, 184.1, 276.1, 284.1, 282.1, 183.4, 248/297.31, 292.12, 917, 919, 921, 922, 248/923, 288.51, 278.1; 403/52, 112, 113, 403/119

See application file for complete search history.

(56) References Cited

U.S. PATENT DOCUMENTS

| | | | | | |
|---|---|---|---|---|---|
| 273,857 | A | * | 3/1883 | Kirk | 248/207 |
| 376,617 | A | * | 1/1888 | Vance | 362/457 |
| 602,625 | A | * | 4/1898 | La Fave | 74/551.4 |
| 790,217 | A | * | 5/1905 | Mason | 108/1 |
| 818,982 | A | * | 4/1906 | Skelley | 379/454 |
| 981,948 | A | * | 1/1911 | Rosenthal | 248/276.1 |
| 999,283 | A | * | 8/1911 | White | 248/282.1 |
| 1,114,948 | A | * | 10/1914 | Walker | 108/5 |
| 1,382,783 | A | * | 6/1921 | Howard | 248/276.1 |
| 1,732,489 | A | * | 10/1929 | Uckotter | 248/278.1 |
| 1,812,744 | A | * | 6/1931 | Glenn | 248/282.1 |
| 2,466,722 | A | * | 4/1949 | May | 248/278.1 |
| 2,650,788 | A | * | 9/1953 | Hulstein | 248/231.71 |
| 3,072,374 | A | * | 1/1963 | Bodian | 248/278.1 |
| 3,374,347 | A | * | 3/1968 | Hirose | 403/111 |
| 4,320,884 | A | * | 3/1982 | Leo | 248/276.1 |
| 4,491,435 | A | * | 1/1985 | Meier | 403/55 |
| 4,546,708 | A | * | 10/1985 | Wilburth | 108/94 |
| 4,592,526 | A | * | 6/1986 | Kobelt | 248/284.1 |
| 4,682,749 | A | * | 7/1987 | Strater | 248/284.1 |
| 5,425,782 | A | | 6/1995 | Phillips | |
| 5,562,737 | A | | 10/1996 | Graf | |
| 5,623,742 | A | | 4/1997 | Journee et al. | |
| 5,723,018 | A | | 3/1998 | Cyprien et al. | |
| 5,725,597 | A | | 3/1998 | Hwang | |

(Continued)

*Primary Examiner* — Kimberly Wood
(74) *Attorney, Agent, or Firm* — Seager, Tufte & Wickhem, LLC

(57) ABSTRACT

Positioning apparatuses mountable to a wheelchair or other such device are disclosed. An illustrative positioning apparatus can include a base unit, a number of armatures each defining an extension of the apparatus, a number of rotatable joints adapted to permit movement of the armatures, and a platform adapted to support one or more objects. A number of actuation levers connected to the rotatable joints can be used to simultaneously unlock each of the joints in a single step, allowing the apparatus to be easily repositioned. A locking mechanism within each joint may permit one or more user-defined locking positions to be set on the joint. A temporary lock-out mechanism within each joint results in the unlocking of each joint until the armatures are rotated away from the locked position, allowing operation of the device with one hand.

40 Claims, 35 Drawing Sheets

U.S. PATENT DOCUMENTS

| | | | | |
|---|---|---|---|---|
| 5,727,569 | A | 3/1998 | Benetti et al. | |
| 5,895,428 | A | 4/1999 | Berry | |
| 5,921,695 | A | 7/1999 | Warner | |
| 6,083,263 | A | 7/2000 | Draenert et al. | |
| 6,123,706 | A | 9/2000 | Lange | |
| 6,171,039 | B1 | 1/2001 | Seurujarvi | |
| 6,197,063 | B1 | 3/2001 | Dews | |
| 6,228,120 | B1 | 5/2001 | Leonard et al. | |
| 6,241,730 | B1 | 6/2001 | Alby | |
| 6,248,132 | B1 | 6/2001 | Harris | |
| 6,273,390 | B1 | 8/2001 | Meyer | |
| 6,302,887 | B1 | 10/2001 | Spranza et al. | |
| 6,575,653 | B1 * | 6/2003 | Krauter | 403/55 |
| 6,581,892 | B2 * | 6/2003 | Carnevali | 248/276.1 |
| 6,688,798 | B2 | 2/2004 | McDevitt | |
| 7,000,304 | B2 | 2/2006 | Sarkisian | |
| 7,243,892 | B2 * | 7/2007 | Pfister | 248/371 |
| 7,380,760 | B2 * | 6/2008 | Dittmer | 248/278.1 |
| D579,585 | S | 10/2008 | Walker et al. | |
| 7,461,826 | B2 * | 12/2008 | Carnevali | 248/292.12 |
| 2004/0159757 | A1 * | 8/2004 | Pfister | 248/284.1 |
| 2006/0022102 | A1 * | 2/2006 | Dittmer | 248/276.1 |
| 2006/0186295 | A1 * | 8/2006 | Dittmer et al. | 248/284.1 |

* cited by examiner

MOUNTING AND POSITIONING APPARATUS FOR INCREASED USER INDEPENDENCE

FIELD

The present invention relates generally to mounting and positioning apparatuses. More specifically, the present invention pertains to versatile positioning apparatuses mountable to a wheelchair or other such device for increasing user independence.

BACKGROUND

The number of individuals using mobility devices such as wheelchairs and walkers is growing at a steady rate as a result of changing age demographics in the population. According to a recent U.S. Census estimate, approximately 2.2 million individuals are currently using wheelchairs for mobility purposes, many of whom have diseases or conditions that require constant assistance from a caregiver. In addition, many elderly and individuals recovering from surgery or injuries have temporary or permanent mobility impairments that require them to spend a considerable amount of time in a recliner, bed, or wheelchair, resulting in a loss of independence. With the increasing incidence of disability as a person ages, and the general trend towards an increase in the average age of the population, the number of individuals requiring mobility devices is expected to rise. In addition, there is a trend towards increased participation in community, school, and work activities by people with mobility impairments.

As a result of the rising demand for mobility devices, there is an increased need for versatile mounting and positioning technology that permits individuals, even those with minimal strength and dexterity, to easily access and transport personal belongings. For individuals confined to a wheelchair, for example, there is often the need for mounting a tray or other flat surface or receiver to the wheelchair for holding cell phones, emergency call devices, computers, communication devices, remote controls, food, beverages, or other such items. The ease in access to these items often reduces the individual's reliance on their caregiver, providing them with greater independence.

Many existing positioning apparatuses lack the flexibility to be independently positioned or repositioned, and are typically designed for use with only a specific device. Some positioning apparatuses, for example, are designed to function in only a single or a few set positions, which may limit the use of the apparatus to only certain activities. For example, in many hospital and nursing home facilities where living space is often limited, the inability of the positioning apparatus to be set at different positions may prevent the unimpeded movement of a wheelchair through the living space, or may prevent a person from independently exiting a wheelchair or recliner with ease.

The strength, dexterity, and range of motion requirements required to move or adjust many positioning apparatuses often limits their use to particular individuals. For individuals suffering from certain musculoskeletal disorders, for example, the strength required to adjust the device may be greater than the individuals' strength, preventing the adjustment of the device without the aid of a caregiver. In some designs, the mounting device may not be ergonomically suited for the individual. For those individuals requiring a wheelchair who rely upon an electronic speech generating device to communicate, for example, the inability to easily adjust or position the speech generating device may limit their ability to perform other essential functions, such as access food or drink, or suboptimal device placement may cause the user fatigue over time, in some cases exacerbating the individual's condition. As such, there is an ongoing need for versatile positioning apparatuses to permit individuals to transport and reposition objects with minimal strength and dexterity.

BRIEF SUMMARY

The present invention pertains to positioning apparatuses mountable to a wheelchair or other such device for providing increased user independence. A positioning apparatus in accordance with an illustrative embodiment can include a base unit, one or more armatures each defining an extension of the apparatus, one or more rotatable joints adapted to permit pivotal movement of the one or more armatures, and a tiltable platform adapted to support one or more objects.

A number of actuation levers can be utilized to unlock each of the joints, allowing the armatures to be adjusted between a number of different positions. In some embodiments, for example, a first actuation lever operatively coupled to a shoulder and elbow joint of the apparatus can be used to simultaneously unlock each of the joints, allowing the user to reposition each of the armatures in one action. A second actuation lever, in turn, can be configured to unlock a rotatable wrist joint operatively coupled to the platform, allowing the platform to be rotated to one or more different positions. Each of the joints can be configured to rotate, either endlessly or within a range of about 0° to 360°. In some embodiments, one or more of the joints can include a locking mechanism for setting one or more user-defined positions that can be used to lock the positioning of the joint at certain positions while being rotated. An adjustable friction system within each joint can also be employed in addition to, or in lieu of, the locking mechanism to apply a frictional force that provides variable resistance to the rotation of the joint. This may be valuable, for example, in addressing the physical characteristics of various end users, where some individuals may have strong, less controllable movements and others are weak.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized. While several illustrative embodiments are described herein with respect to the wheelchairs, it should be understood that the apparatus could be used in conjunction with other types of devices. Examples of other devices can include, but are not limited to, walkers, beds, chairs, recliners, sofas, tables, walls, work stations, vehicles, and floor stands.

Figure 1:
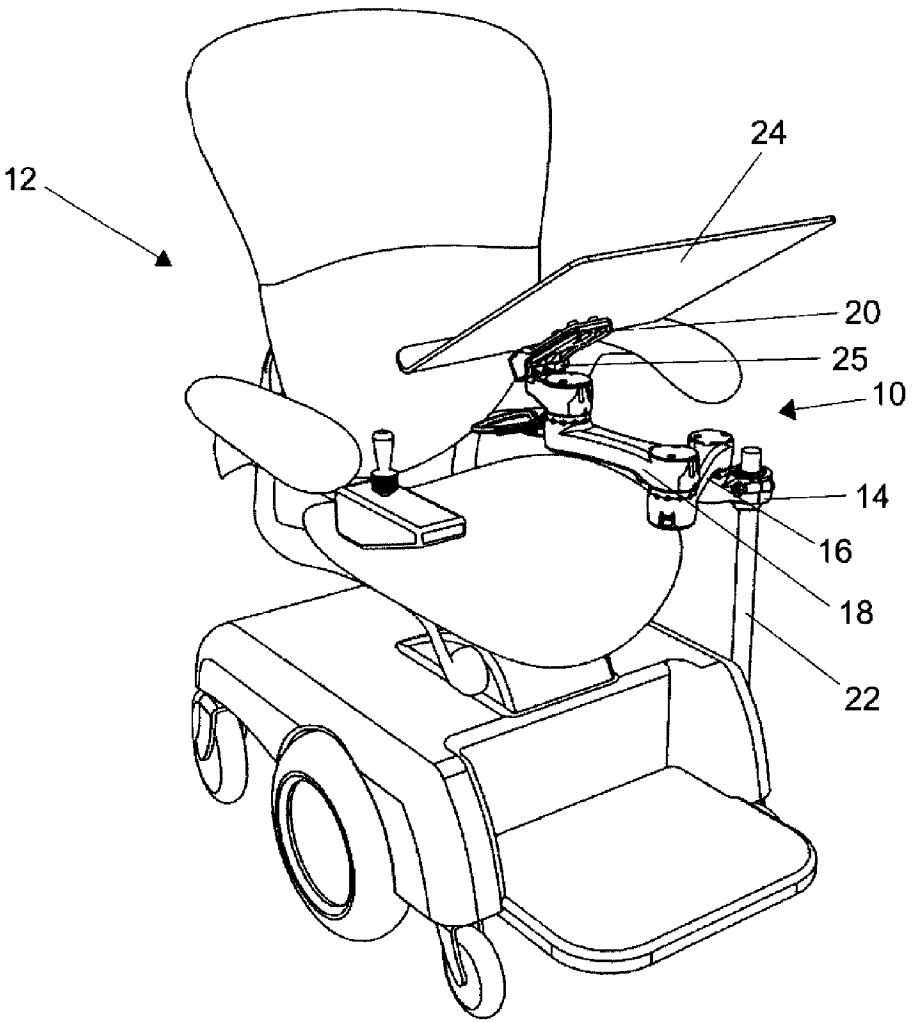
FIG. 1 is a perspective view of a positioning apparatus in accordance with an illustrative embodiment.

Referring now to FIG. 1, a perspective view of an illustrative positioning apparatus 10 attached to a mounting device such as a wheelchair 12 will now be described. Apparatus 10, illustratively a dual-armature positioning apparatus, includes a base unit 14, a first armature 16 coupled to the base unit 14, a second armature 18 coupled to the first armature 16, and a platform 20 coupled to the second armature 18. In the illustrative embodiment depicted, the base unit 14 of the apparatus 10 is shown attached to the wheelchair 12 via a mounting rod 22, which provides a mounting support for securing the apparatus 10 at a location adjacent to the wheelchair 12. The base unit 14 can be slidably adjusted on the mounting rod 22 in order to raise or lower the height of the positioning apparatus 10 on the wheelchair 12, as desired.

The first armature 16 can be configured to pivot relative to the base unit 14, allowing the apparatus 10 to be moved in a first degree of freedom relative to the base unit 14. The second armature 18, in turn, can be configured to pivot relative to the first armature 16, allowing the apparatus 10 to be moved in a second degree of freedom relative to the base unit 14. In use, the platform 20 can be configured to support one or more objects such as a tray 24 adjacent to the wheelchair 12, allowing the individual to hold cell phones, emergency call devices, computers, electronic speech generating devices, remote controls, food, beverages, or other such items within arms reach. During adjustment, and as discussed further herein, the positioning of the armatures 16,18 can be adjusted and, in some cases locked, into a number of different user-defined positions, allowing the user to customize the positioning of the apparatus 10.

In some embodiments, and as further shown in FIG. 1, the platform 20 can include a tilting mechanism 25 that can be used to adjust the incline angle of the tray 24, if desired. The tilt mechanism 25 can include a friction hinge or detent hinge that permits the tray 24 to remain in a set position unless a sufficient force is applied to the tilt mechanism 25, causing the tray 24 to tilt to a new position. In certain embodiments, the force required to tilt the tray 24 can be varied depending on whether the force applied to the tray 24 is in an upward direction or a downward direction. When engaged, the torque resistance required to rotate the tray 24 downwardly to a level, horizontal position is greater than the force required to rotate the platform 20 upwardly to an inclined position. In use, this force differential serves to make it easier to adjust the platform 20 and any attached device upward, to an incline, and to hold the platform 20 in place, resisting downward movement resulting from the weight of the device 10. Additionally, the force differential resists downward movement resulting from an individual applying forces, such as depressing buttons on a cell phone or a speech generating device. In some embodiments, the tilt angle of the platform 20 may be locked. For example, an adjustable pin can be engaged against a gear within the tilt mechanism 25, impeding movement of the gear in either particular direction, holding the platform 20 at a desired angle.

Figure 2:
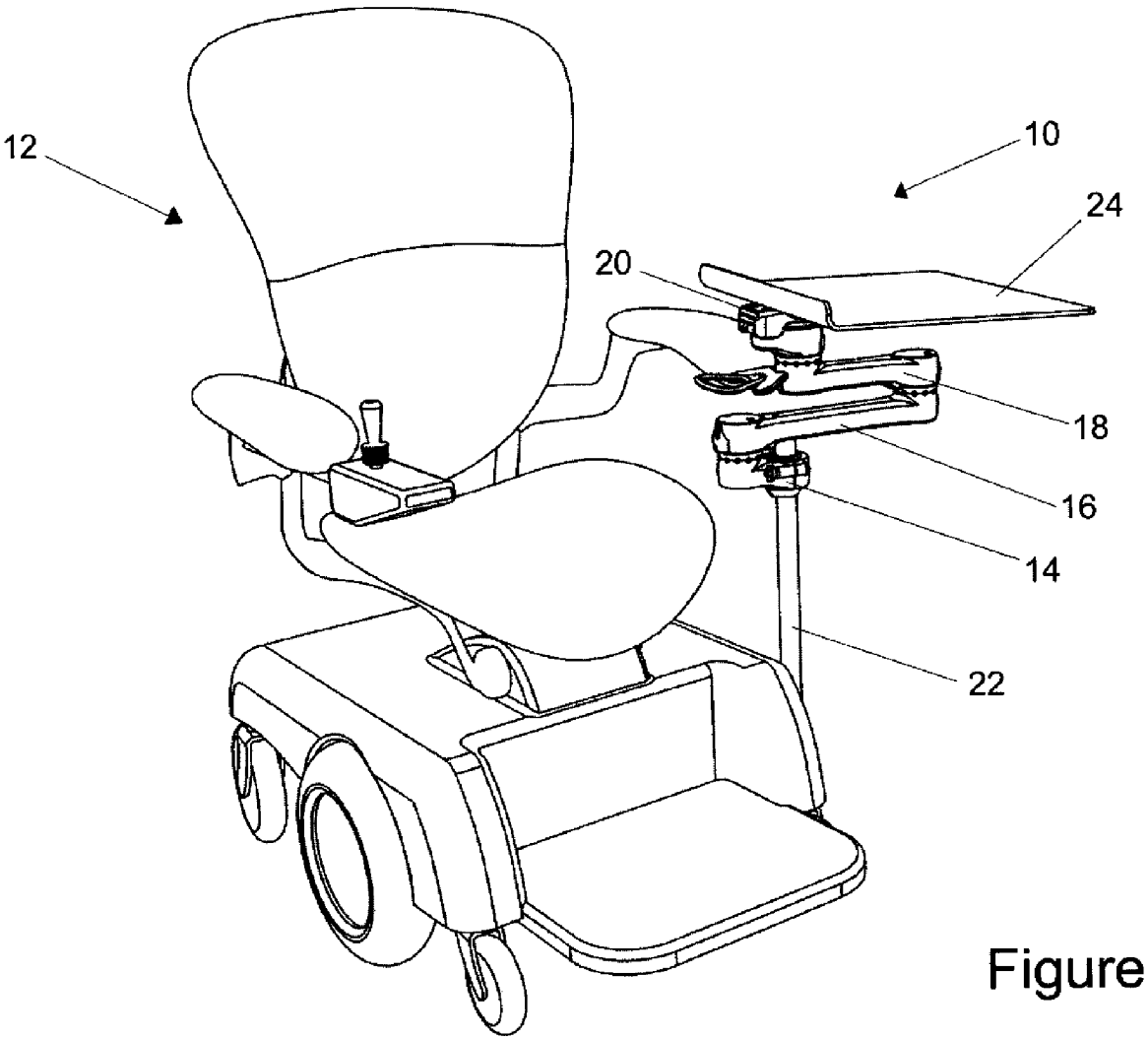
FIG. 2 is another perspective view showing the illustrative positioning apparatus of FIG. 1 in a second position.

FIG. 2 is another perspective view showing the positioning apparatus 10 of FIG. 1 in a second, collapsed position, allowing the occupant to exit the wheelchair, or for use in transporting, using, and/or storing the apparatus 10 adjacent to the wheelchair 12. As shown in FIG. 2, the positioning of the first and second armatures 16,18 can be adjusted so as to swing the apparatus 10 outwardly away from the front portion of the wheelchair 12, reducing the amount of space occupied by the apparatus 10 forward of the individual. In such position, the platform 20 can also be tilted to a level, horizontal position, further impacting the space occupied by the apparatus 10, and providing the user with greater visibility in front of the wheelchair 12.

Figure 3:
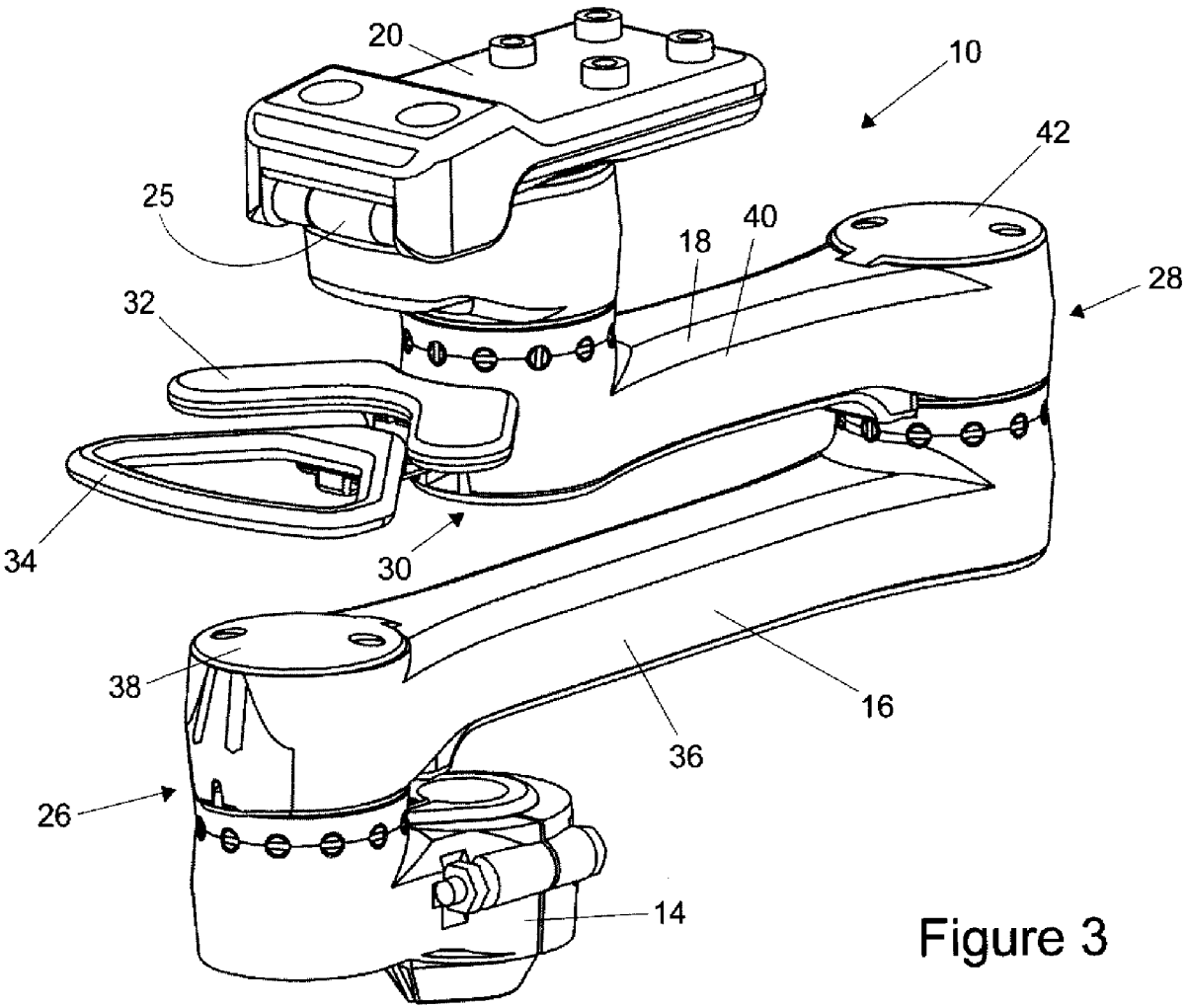
FIG. 3 is a perspective view showing the illustrative positioning apparatus of FIG. 1 in a detached position.

FIG. 3 is a perspective view showing the positioning apparatus 10 of FIG. 1 in a detached position apart from the wheelchair 12. As can be fiber seen in FIG. 3, the apparatus 10 can include a rotatable shoulder joint 26 that can be utilized to adjust the first armature 16 between one ore more positions relative to the base unit 14. A rotatable elbow joint 28, in turn, can be utilized to adjust the second armature 18 between one or more positions relative to the first armature 16. A rotatable wrist joint 30, in turn, can be utilized to rotate the platform 20 between one or more positions relative to the second armature 18, if desired.

A number of actuation levers 32,34 can be utilized to temporarily unlock the joints 26,28,30 for adjusting the positions of the armatures 16,18 and the platform 20. A first actuation lever 32, for example, can be utilized to release the wrist joint 30 from an initially locked position, allowing the user to rotate the platform 20 to another desired position. A second actuation lever 34, in turn, can be utilized to simultaneously unlock each of the shoulder and elbow joints 26,28, allowing the user to reposition one or both armatures 16,18 to a new position in a single step, if desired.

The shape of the actuation levers 32,34 can be configured to facilitate unlocking of the joints 26,28,30 from different sides of the apparatus 10. The first actuation lever 32, for example, may have a U-shaped configuration, allowing the user to easily grasp the lever 32 from different sides of the apparatus 10. The second actuation lever 34, in turn, may have a hoop-shaped configuration allowing the user to easily grasp the lever 34 from different sides and/or from the end of the lever 34. The actuation levers 32,34 may be positioned adjacent to each other to permit the user to engage both levers 32,34 simultaneously with one hand.

The first armature 16 can include a housing 36 and a cap 38, defining a first extension of the apparatus 10 that can be rotated relative to the base unit 14 by actuation of the shoulder joint 26. In some embodiments, the shoulder joint 26 can be configured to rotate endlessly one or more times, allowing the first armature 16 to be freely rotated in either a clockwise or counterclockwise direction. Alternatively, and in other embodiments, the shoulder joint 26 can be configured to rotate at an angle in the range of about 0° to 360° relative to the base unit 14, having at least one stop that limits rotation of the joint 26.

The second armature 18, in turn, can include a housing 40 and cap 42, defining a second extension of the apparatus 10 that can be rotated relative to the first armature 16 by actuation of the elbow joint 28. As with the shoulder joint 26, the elbow joint 28 can be configured to rotate endlessly one or more times in either a clockwise or counter-clockwise direction, or alternatively, can be configured to rotate at an angle in the range of about 0° to 360° and then reversed. The armatures 16,18 can each be made from a lightweight material such as an aluminum or zinc alloy in order to reduce the overall weight of the apparatus 10. It should be understood, however, that other types of metals and/or polymeric materials may be used.

In some embodiments, the first and second armatures 16,18 can be configured to move in only a single plane. In the illustrative embodiment of FIG. 1, for example, the first and second armatures 16,18 can be configured to move in only a horizontal plane, allowing the user to horizontally reposition the armatures 16,18 without inadvertently moving the armatures 16,18 vertically in either a downward or upward position. Other configurations are possible, however.

Although the illustrative embodiment depicted in FIG. 1 includes two independently adjustable armatures 16,18, it should be understood that the apparatus 10 can be equipped with a greater or lesser number of armatures and/or joints, if desired. In some embodiments, for example, the apparatus can be equipped with only a single armature and joint to impart only a single degree of freedom of movement to the apparatus, if desired. Moreover, while the apparatus can include a tiltable platform coupled to a wrist joint, it should be understood that the platform could be configured as a fixed (i.e. non-tiltable) platform, with or without the wrist joint.

Figure 4:
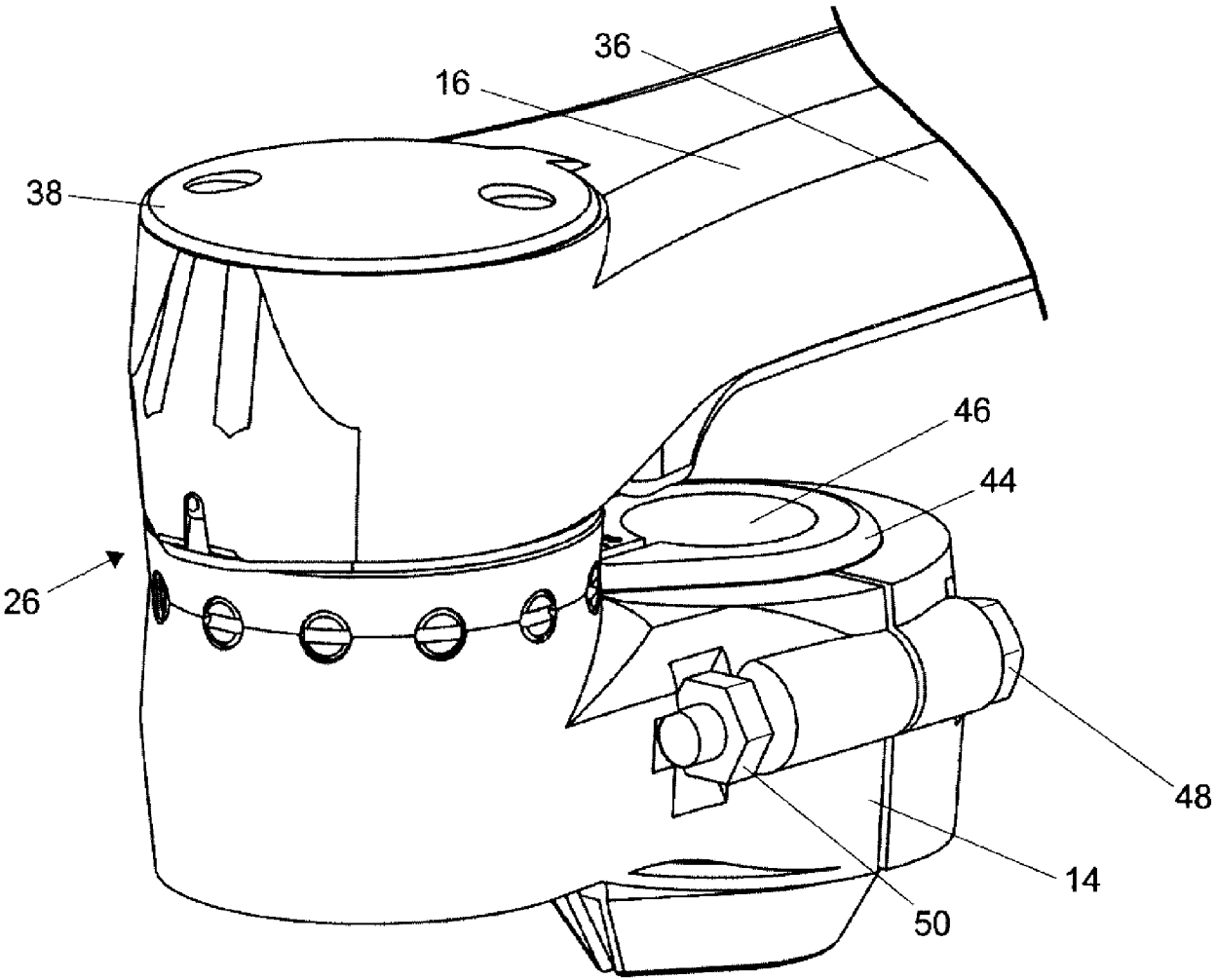
FIG. 4 is a view showing the base unit of FIG. 3.

FIG. 4 is a view showing the base unit 14 of FIG. 3 in greater detail. As can be further seen in FIG. 4, the base unit 14 can include a tube clamp bushing 44 defining an adjustable sleeve 46 for attachment to a mounting support such as the mounting rod 22 depicted in FIG. 1. In certain embodiments, for example, the tube clamp bushing 44 can comprise a cylindrically shaped sleeve adapted to clamp onto a ⅞" or other sized rod or tube. A number of bolts 48 each adapted to engage a corresponding nut 50 may be provided to adjust the size of the sleeve 46. While a cylindrically-shaped adjustable sleeve 46 is depicted in FIG. 4, it should be understood that the sleeve 46 could be configured to secure to other shaped mounting supports. Other means for attaching the base unit 14 to the mounting device may also be employed, if desired.

Figure 5:
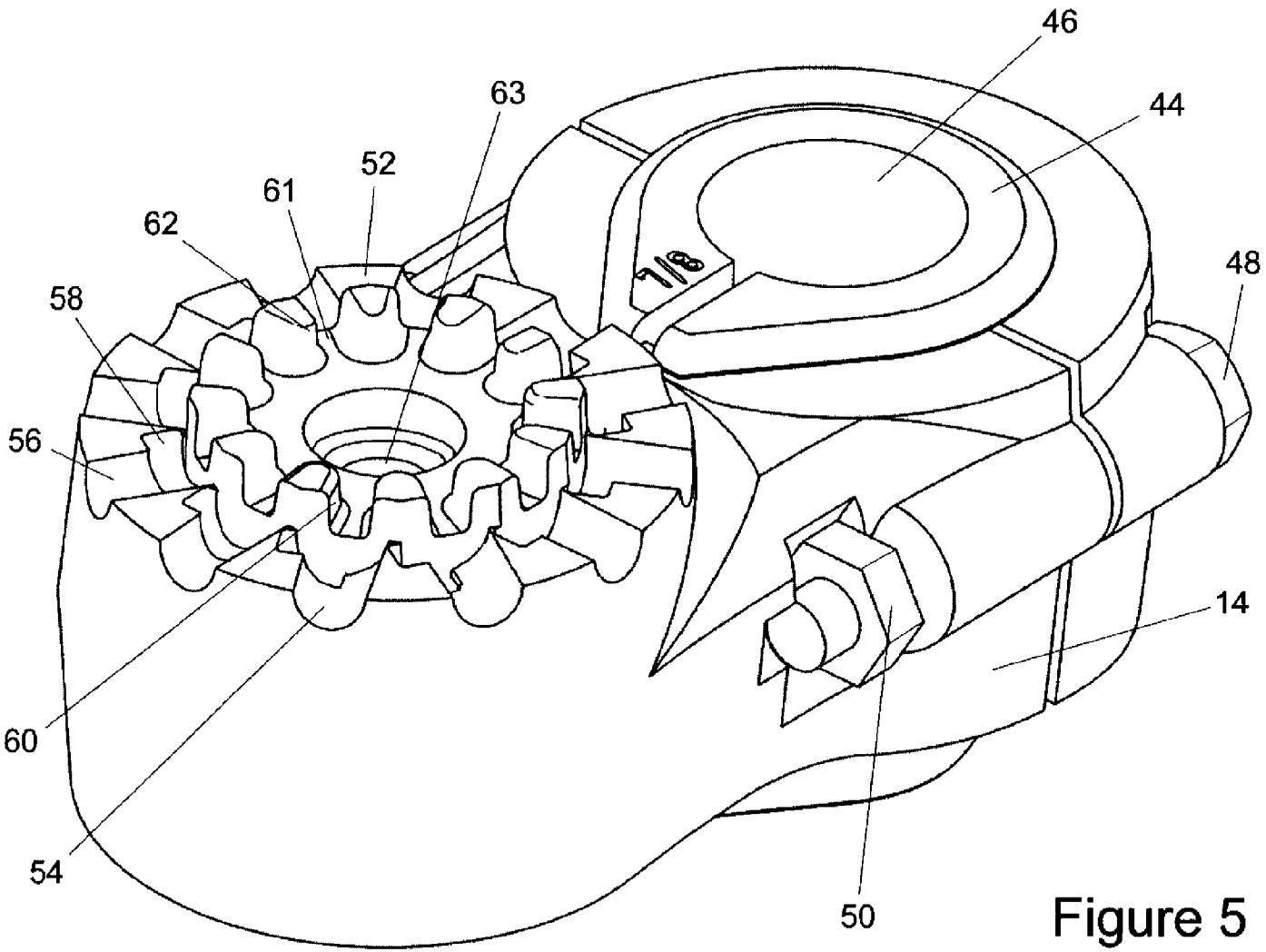
FIG. 5 is a view showing the interior of the base unit of FIG. 3.
Figure 19:
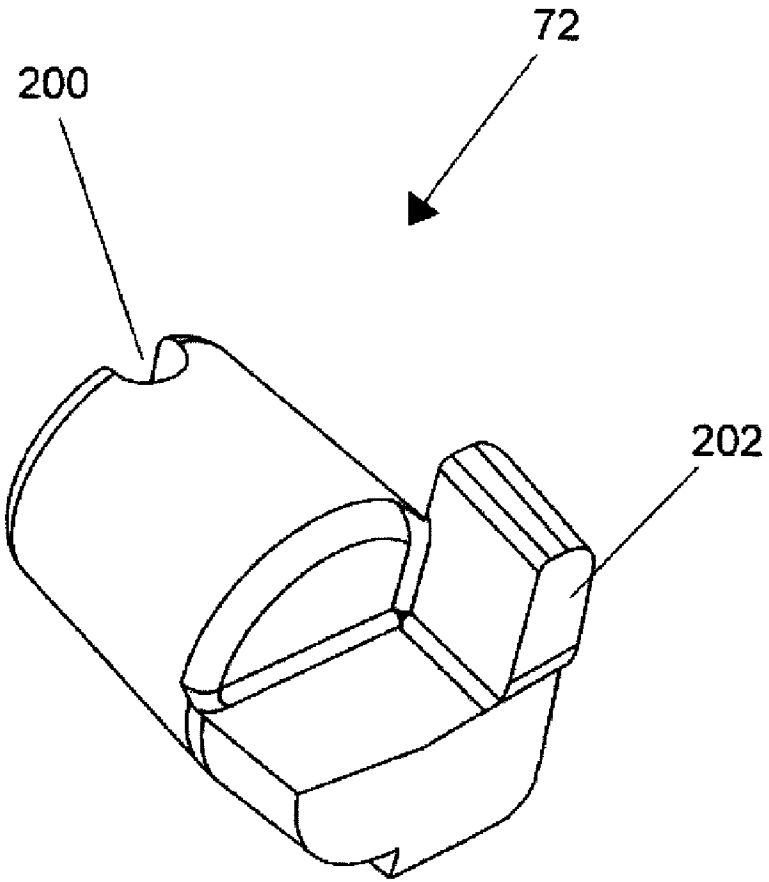
FIG. 19 is a perspective view showing one of the twistlets in greater detail.
Figure 20:
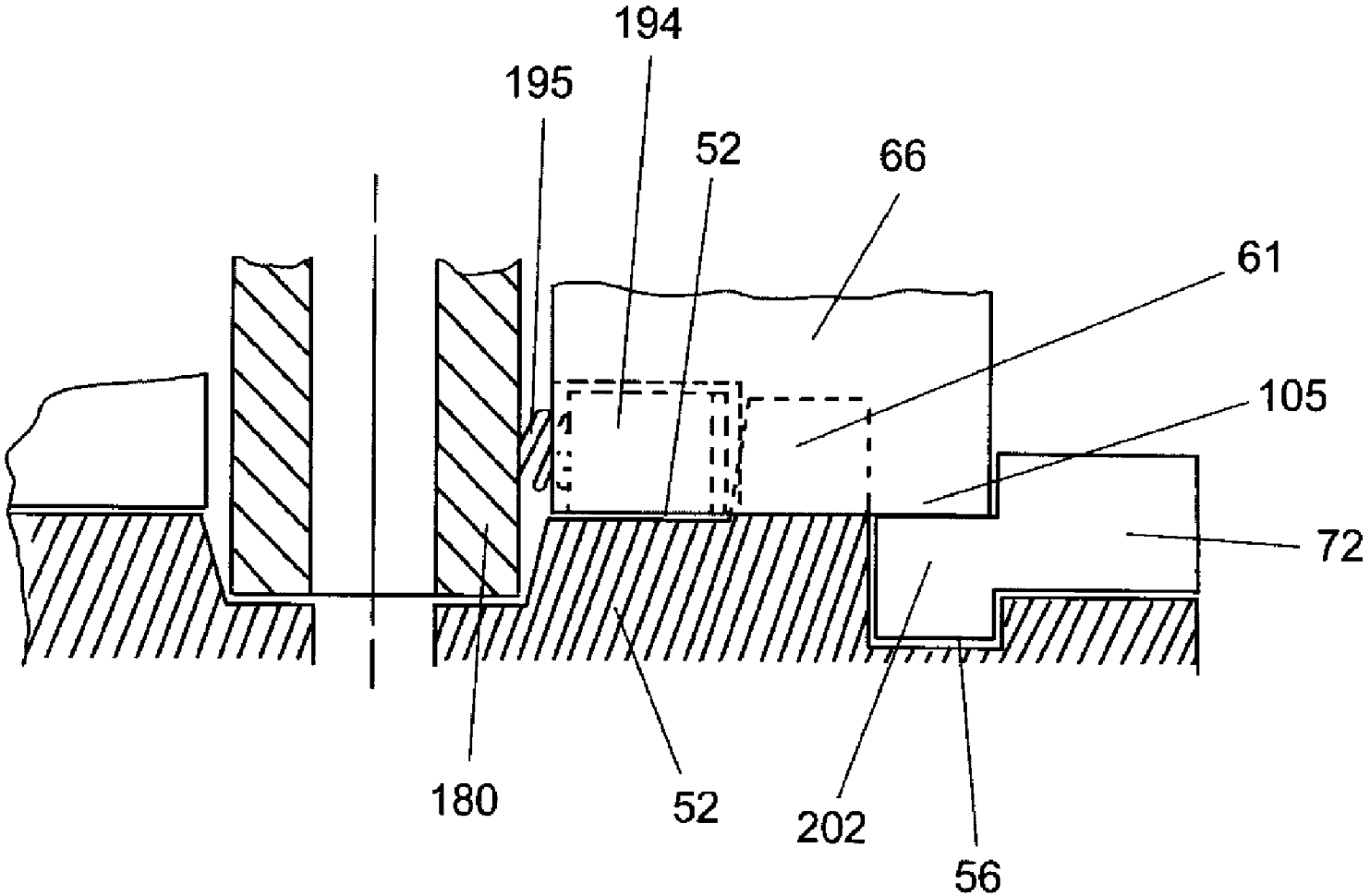
FIGS. 20-23 are several diagrammatic views showing the lock/temporarily unlock actuation sequence of the bucket.

FIG. 5 is a view showing the interior of the base unit 14 of FIG. 3. As shown in FIG. 5, the base unit 14 may include a seat 52 defining a number of radially arranged grooves 54 each adapted to receive a corresponding twistlet 72 (see FIG. 19) that can be used to trigger a locking mechanism within the shoulder joint 26 for locking the rotational positioning of the joint 26 at various radial increments. In certain embodiments, for example, the seat 52 may define twelve radial grooves 54, which, during adjustment, allow the user to lock the position of the shoulder joint 26 at 30° radial increments. It should be understood, however, that the seat 52 may have a different number of radial grooves 54 to permit the shoulder joint 26 to be indexed at other radial increments, if desired. Each of the grooves 54 can include a first section 56 that extends inwardly from the outer periphery of the seat 52, and a second section 58 that extends inwardly from the first section 56 at a depth slightly deeper and substantially perpendicular to the length of the first section 56.

A number of guide tabs 60 on the seat 52 can be provided to engage an unlocking wedge 194 (see FIG. 25) that prevents the shoulder joint 26 from locking as the joint 26 is rotated between each new position. Each of the guide tabs 60 may form a groove 61, and can be chamfered slightly along an engagement surface 62 thereon to facilitate the smooth indexing of the wedge 194 as it seeks each new position. An opening 63 within the interior of the seat 52 can be configured to receive a portion of an elongated member 166 shown, for example, in the wrist joint 30 of FIG. 14.

Figure 6:
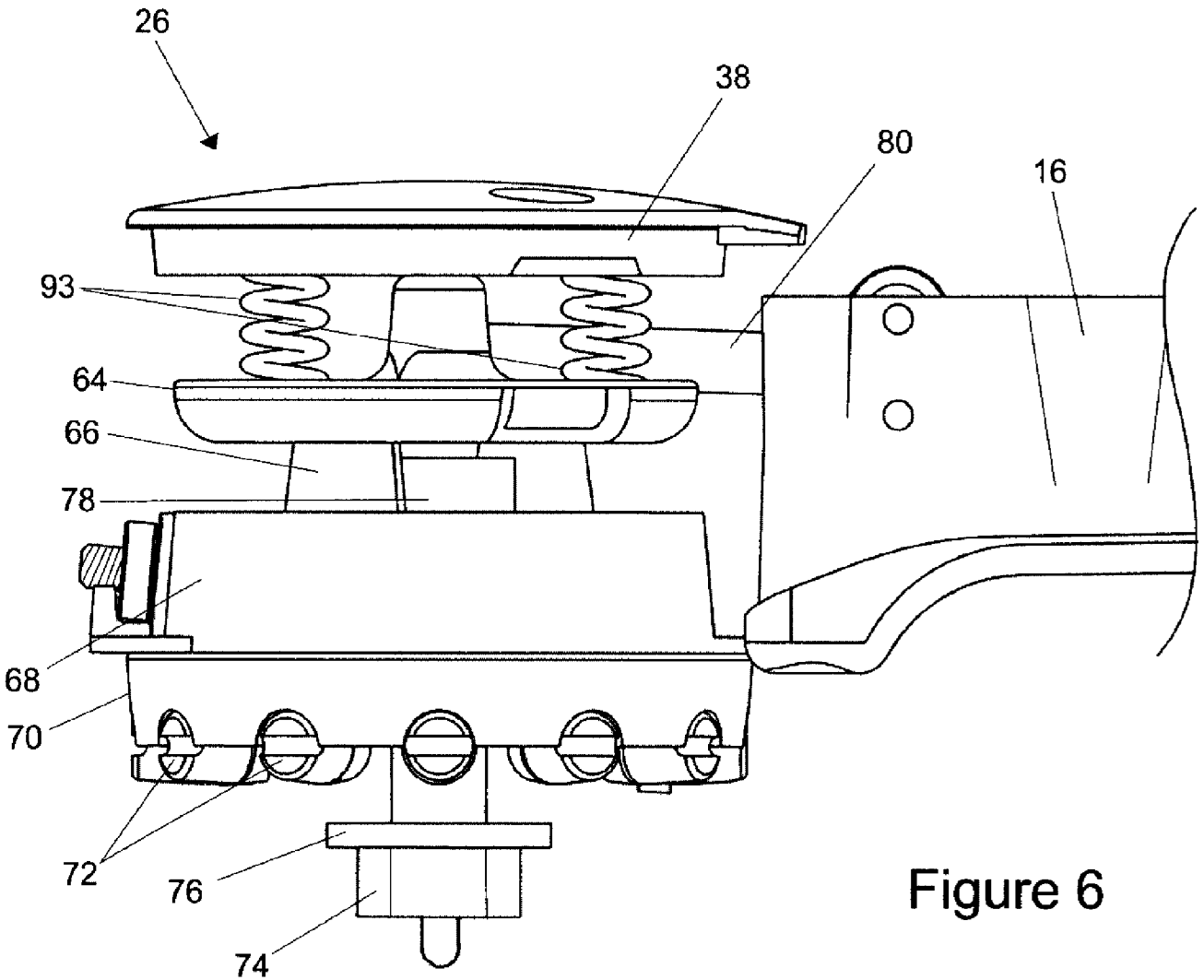
FIG. 6 is an exploded view showing the interior of one of the joints of FIG. 3.

FIG. 6 is an exploded view of the shoulder joint 26 of FIG. 3, with the armature housing 36 of the first armature 16 and the base unit 14 removed to show the internal components of the joint 26 in greater detail. As shown in FIG. 6, the shoulder joint 26 can include bucket handle 64, a bucket 66, and a friction bearing 68. The bucket 66, in combination with the twistlets 72, permit the user to rotate and lock the joint 26 into a number of different user-defined positions. A keeper 70 and a number of twistlets 72 engaging the grooves 54 on the seat 52 can be configured to permit the user to set one or more positions on the joint 26 to limit or prevent rotational movement of the joint 26. The bucket 66, friction bearing 68, and keeper 70 can be coupled together via a hollow bolt 74, washer 76, and nut 78. A number of springs 93 can be provided to spring load the bucket handle 64 against the cap 38. During adjustment, and as discussed in further detail herein, a lever 80 operatively coupled to the second actuation lever 34 can be configured to engage the bucket handle 64 to unlock the shoulder joint 26.

Figure 7:
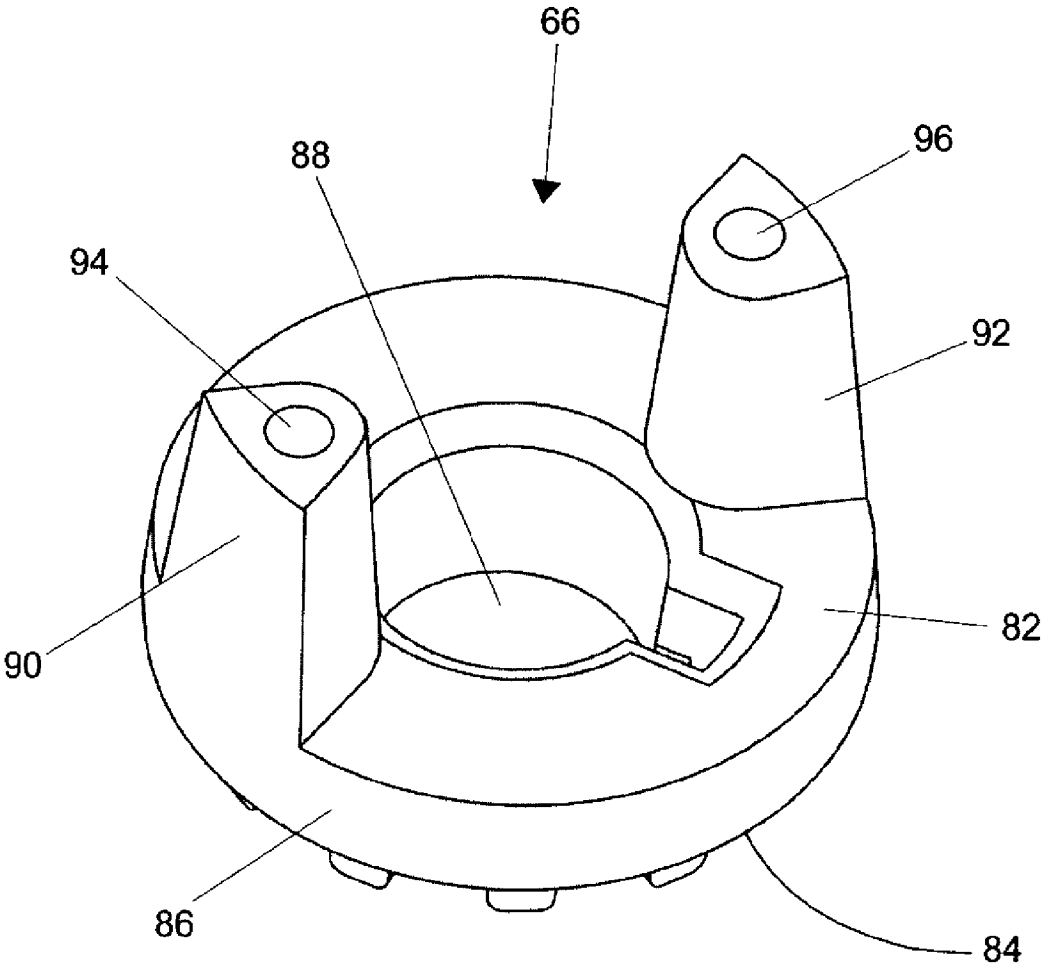
FIGS. 7-8 are top and bottom perspective views, respectively, showing the bucket of FIG. 6.
Figure 8:
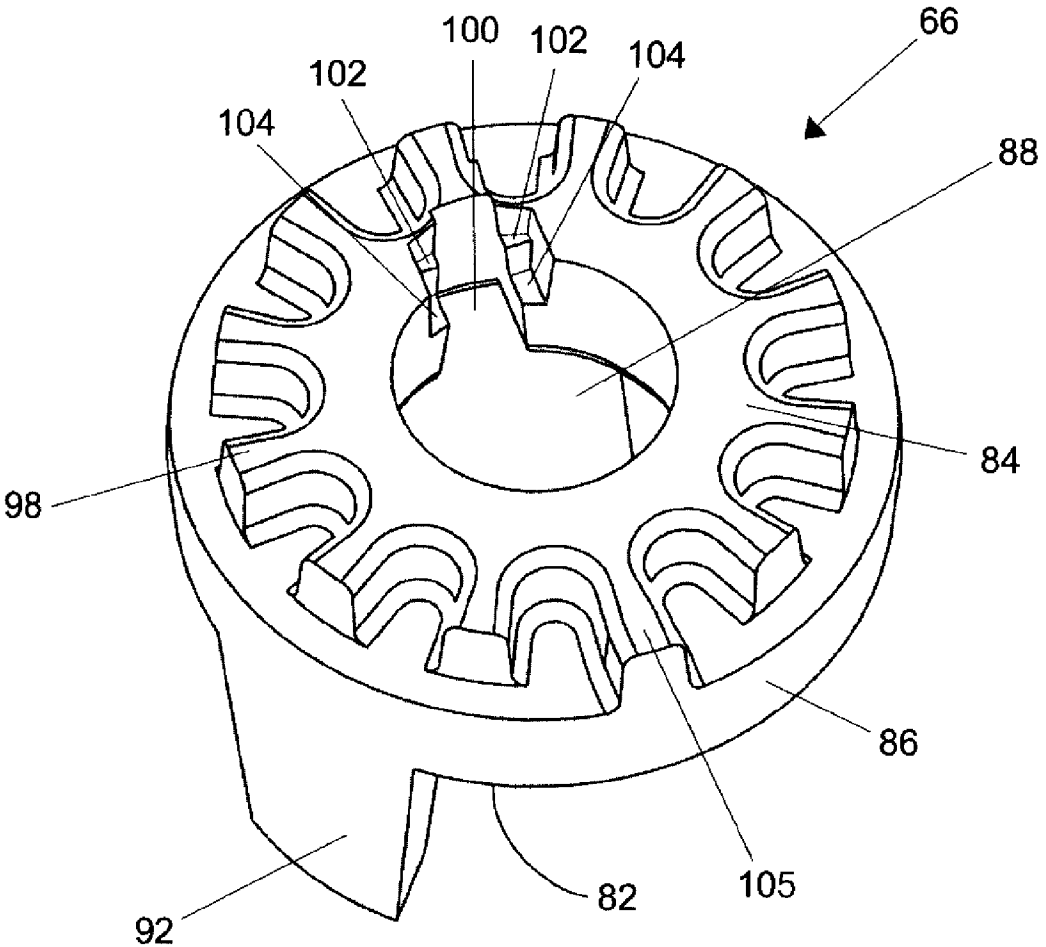

FIGS. 7-8 are top and bottom perspective views, respectively, showing the bucket 66 of FIG. 6 in greater detail. As shown in a top perspective view in FIG. 7, the bucket 66 can comprise a circular-shaped member having a top section 82, a bottom section 84, an outer periphery 86, and a central opening 88 therethrough. A number of pillars 90,92 extending upwardly from the top section 82 of the bucket 66 are provided for attaching the bucket 66 to a bottom portion of the bucket handle 64. Each of the pillars 90,92 can include a threaded opening 94,96 adapted to receive therein a corresponding screw from the bucket handle 64, which is used to secure the two members 64,66 together.

As can be further seen in the bottom perspective view depicted in FIG. 8, the bottom section 84 of the bucket 66 can include a number of tabs 98 disposed radially about the outer periphery 86 of the bucket 66 and corresponding in number and arrangement with the radial grooves 54 located on the seat 52 of the base unit 14. In certain embodiments, for example, the bottom section 84 of the bucket 66 can include twelve tabs 98 disposed at equal 30° radial increments. It should be understood, however, that the tabs 98 can vary in number and/or arrangement depending on the particular configuration of the apparatus 10. In use, when the shoulder joint 26 is in a locked position, each of the tabs 98 on the bucket 66 is configured to firmly engage a respective groove 61 on the seat 52. In this position, the engagement of the tabs 98 within the grooves 61 prevent the joint 26 from being rotated further, thus locking the first armature 16 into place.

Figure 15:
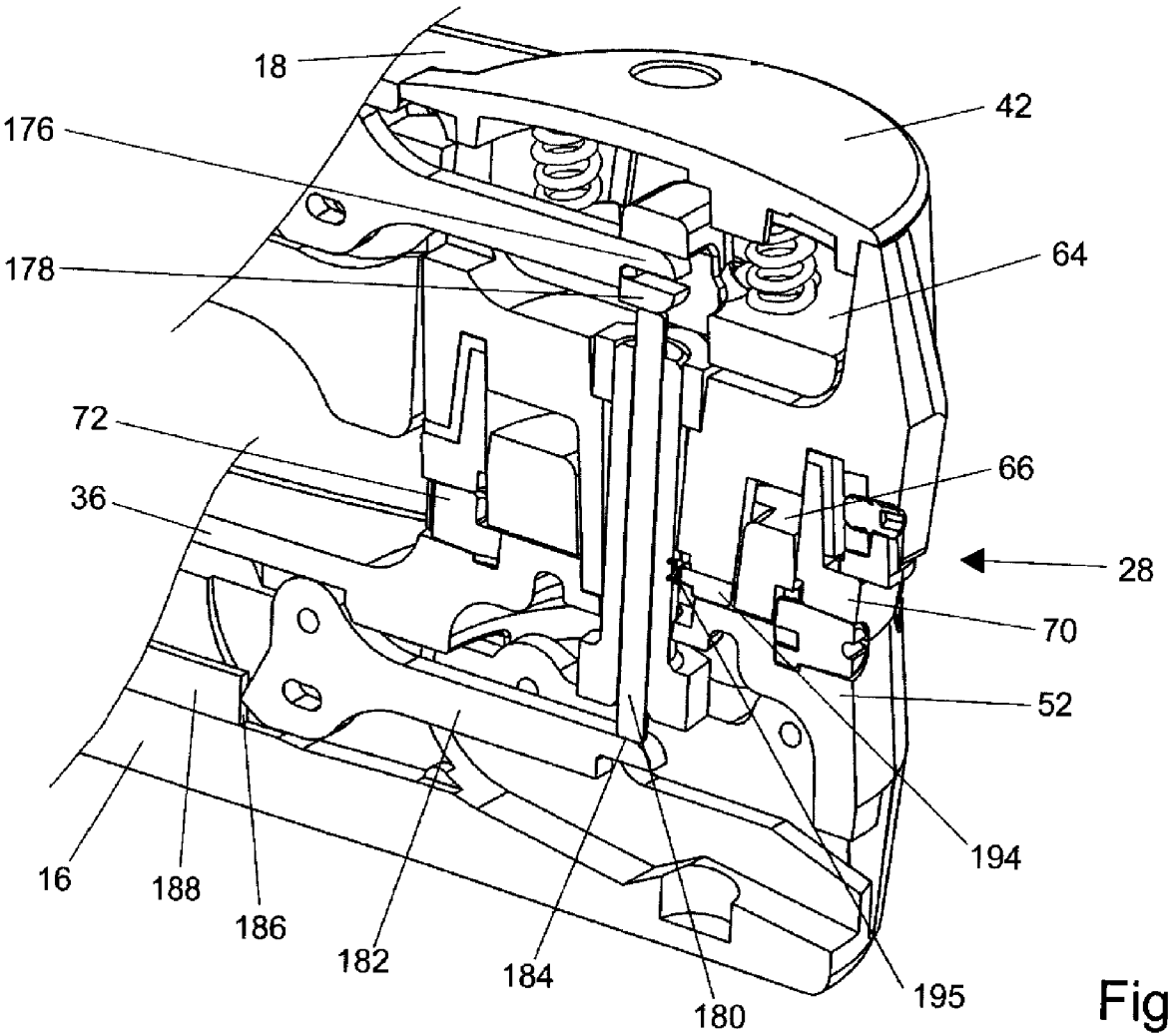
FIGS. 15-18 are several partial cross-sectional views showing the actuation of the temporary unlock wedge within the elbow joint.

An inset portion 100 of the bucket 66 can be configured to receive an unlocking wedge 194 (see FIG. 15) that can be used to prevent the shoulder joint 26 from becoming locked once the second actuation lever 34 has been engaged and until, and at such point, the positioning of the shoulder joint 26 has been adjusted. The inset portion 100 may extend from the bottom section 84 of the bucket 66 to the top section 82 thereof at a location adjacent to the central opening 88. A number of ledges 102,104 located within the interior of the bucket 66 may be provided to permit the bucket 66 to drop towards the seat 52 in two separate stages, as discussed herein.

The bucket 66 may further include a tooth 105 that can be used to scan for the presence of any twistlets 72 that have been set to an engaged or locked position by the user. The tooth 105, which replaces one of the tabs 98 located on the bottom side 84 of the bucket 66, may extend towards the outer periphery 86 of the bucket 66, and is configured to come into contact with the twistlets 72 as the joint 26 is rotated. In use, the tooth 105 can be used to scan for any twistlets 72 that have been set to an engaged (i.e. locked) position. When the tooth 105 finds an engaged twistlet 72, the tooth 105 is permitted to drop, allowing the bucket 66 to lock into position against the seat 52.

Figure 9:
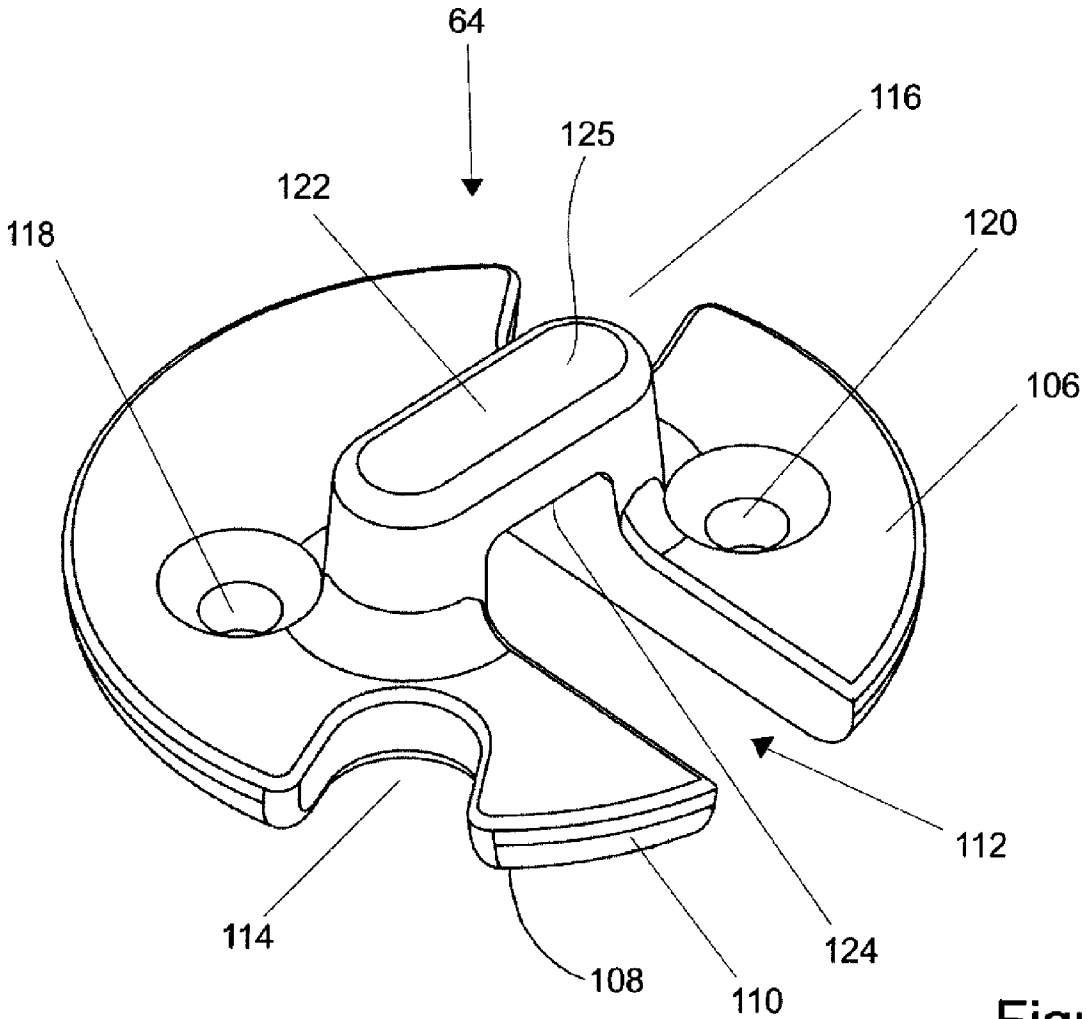
FIG. 9 is a perspective view showing the bucket handle of FIG. 6.

FIG. 9 is a perspective view showing the bucket handle 64 of FIG. 6 in greater detail. As shown in FIG. 9, the bucket handle 64 may comprise a circular-shaped member having a top section 106, a bottom section 108, and an outer periphery 110. A channel 112 extending from the outer periphery 110 into the interior of the bucket handle 64 is adapted to receive a portion of the lever 80, which, when actuated, can be used to lift the bucket handle 64 and bucket 66. In one embodiment, a number of grooves 114,116 extending inwardly from the outer periphery 110 are each configured to engage a correspondingly shaped post formed on the cap 38. A number of thru-holes 118,120 on the bucket handle 64, in turn, can be used to secure to the bucket handle 64 to the pillars 90,92 of the bucket 66 via a screw or other suitable fastener. In some embodiments, the bucket handle 64 may further be spring loaded against the cap 38 such that, when the lever 80 lifts the bucket handle 64, the bucket 66 is spring biased to return to a locked position against the seat 52. A handle 122 having a bottom surface 124 and an upper surface 125 may extend upwardly from the top section 106 of the bucket handle 64.

Figure 10:
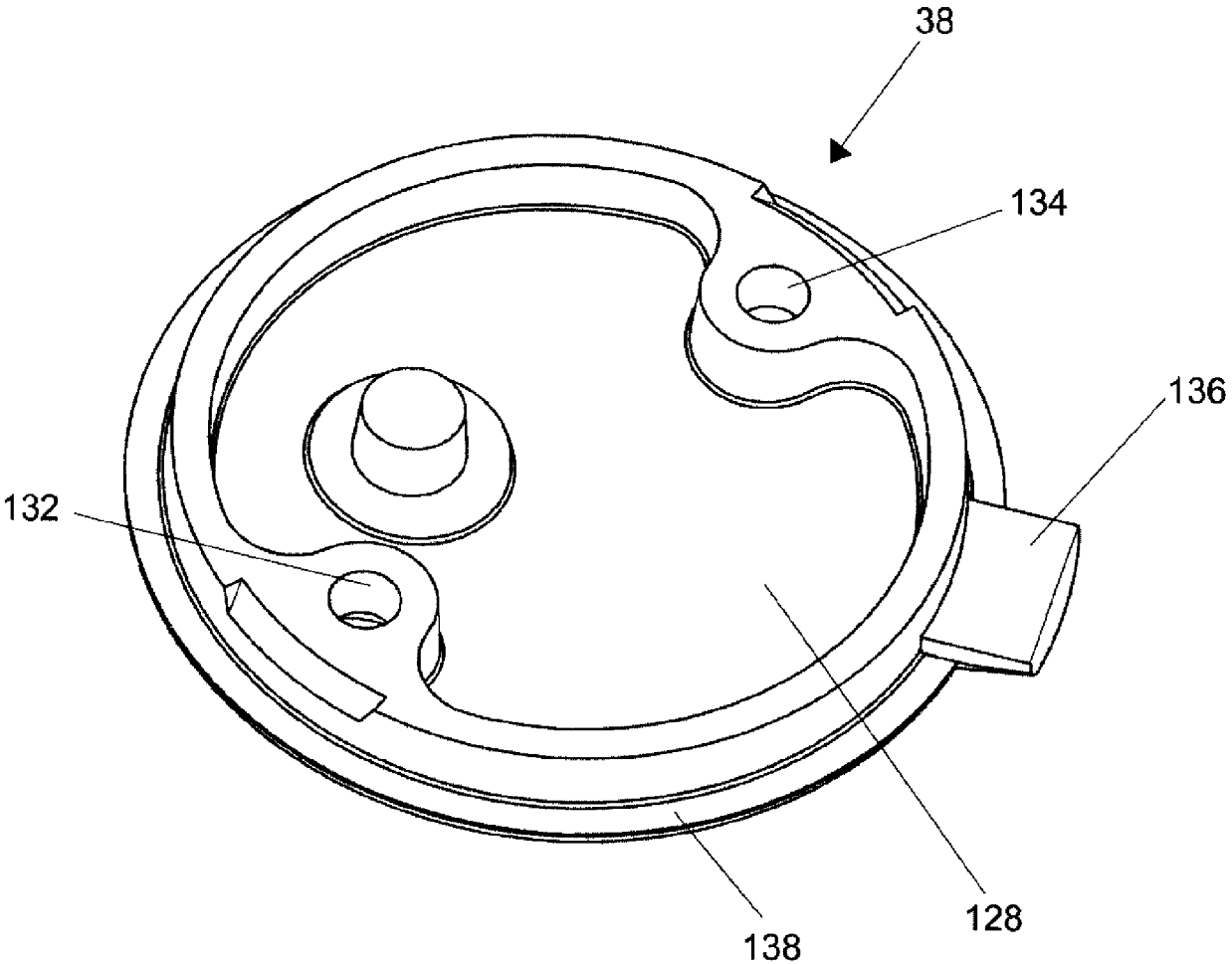
FIG. 10 is a perspective view showing the interior side of the cap of FIG. 6.

FIG. 10 is a perspective view showing the interior side 128 of the cap 38 of FIG. 6. As shown in FIG. 10, the cap 38 can include a number of thru-holes 132,134 for securing the cap 38 to the housing 36 of the first armature 16. An alignment tab 136 extending from an outer periphery 138 of the cap 38 can be provided to align with a notch formed on the housing 36 of the first armature 16.

Figure 11:
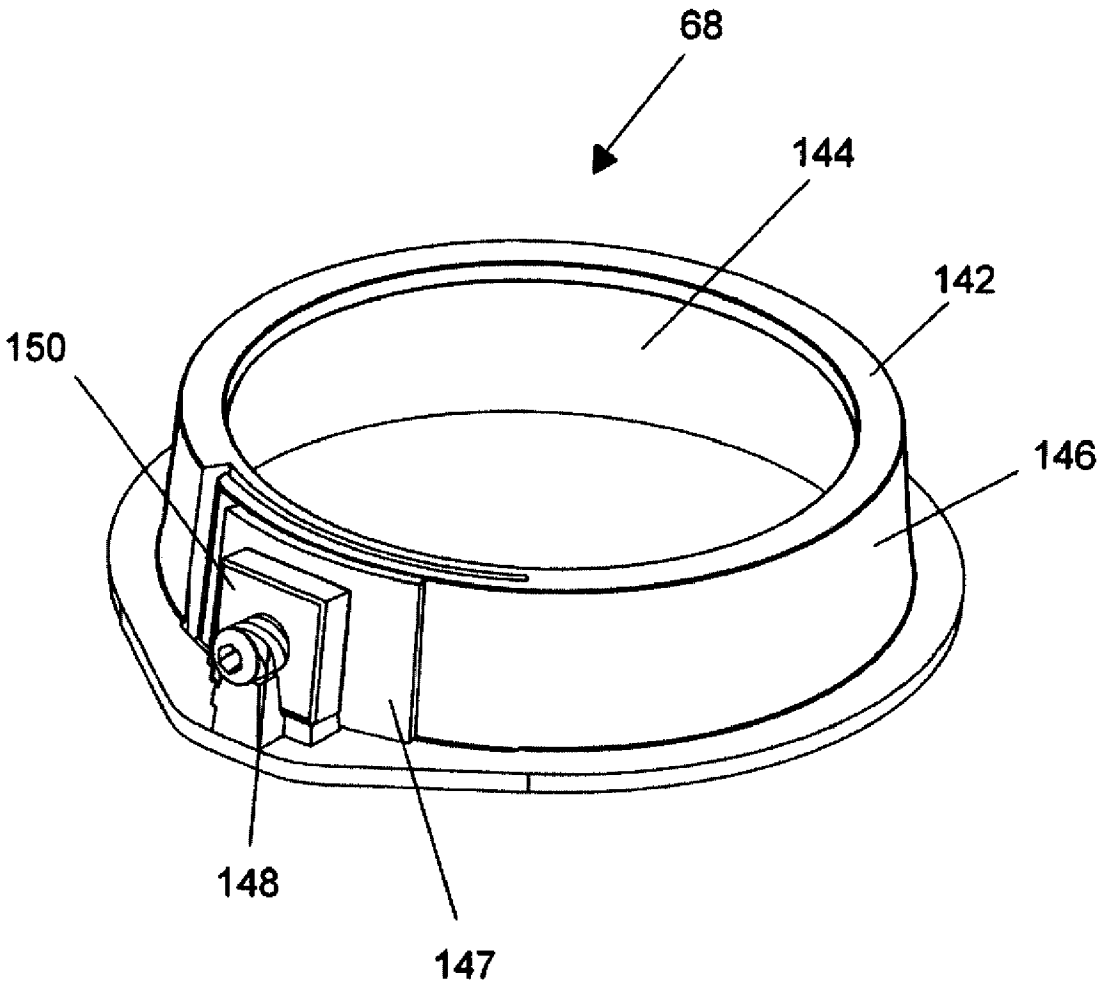
FIG. 11 is a perspective view showing the friction bearing of FIG. 6.

FIG. 11 is a perspective view showing the friction bearing 68 of FIG. 6 in greater detail. As shown in FIG. 11, the friction bearing 68 can include a split-tube collar 142 having an inner surface 144 and an outer surface 146. The inside surface 144 of the collar 142 may lie immediately adjacent to the outer periphery of the keeper 70. A friction plate 147 located adjacent to the outer surface 146 of the collar 142 can be configured to assert a frictional force on the collar 142, which, in use, impedes rotation of the shoulder joint 26.

The amount of friction applied to the collar 142 via the friction plate 147 can be adjusted via a set screw 148 and nut 150. In use, the set-screw 148 can be adjusted to either increase or decrease the amount of friction required to rotate the shoulder joint 26 depending on the user's preferences and/or strength. If, for example, the user desires to reduce the amount of force required to rotate the shoulder joint 26, the user may adjust the set screw 148 in a counterclockwise direction, causing the friction plate 147 to decrease the frictional force asserted against the collar 142. Conversely, if the user desires to increase the amount of force required to rotate the shoulder joint 26, the user may adjust the set screw 148 in a clockwise direction, causing the friction plate 147 to increase the frictional force asserted against the collar 142.

Figure 12:
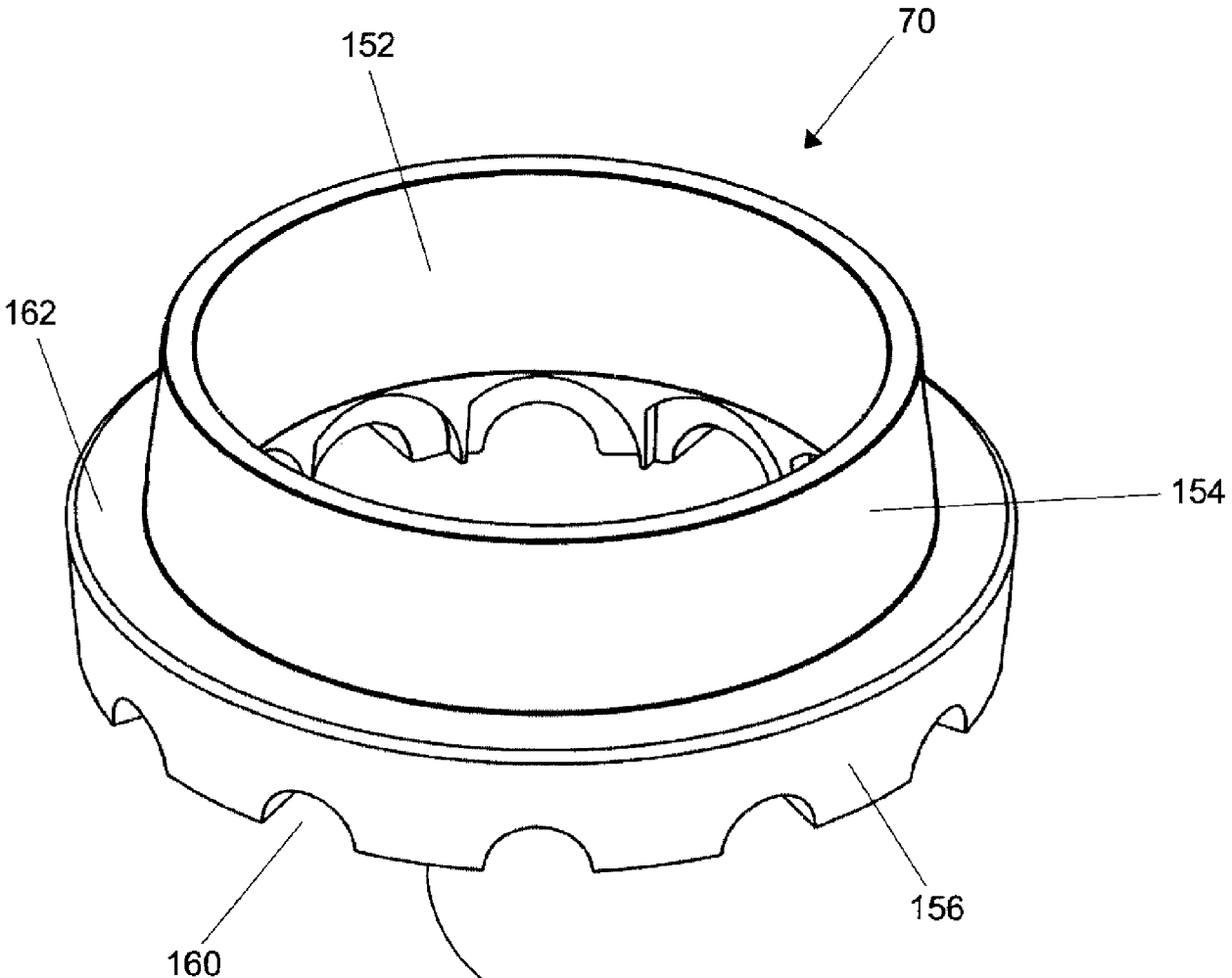
FIGS. 12-13 are top and bottom perspective views, respectively, showing the keeper of FIG. 6.
Figure 13:
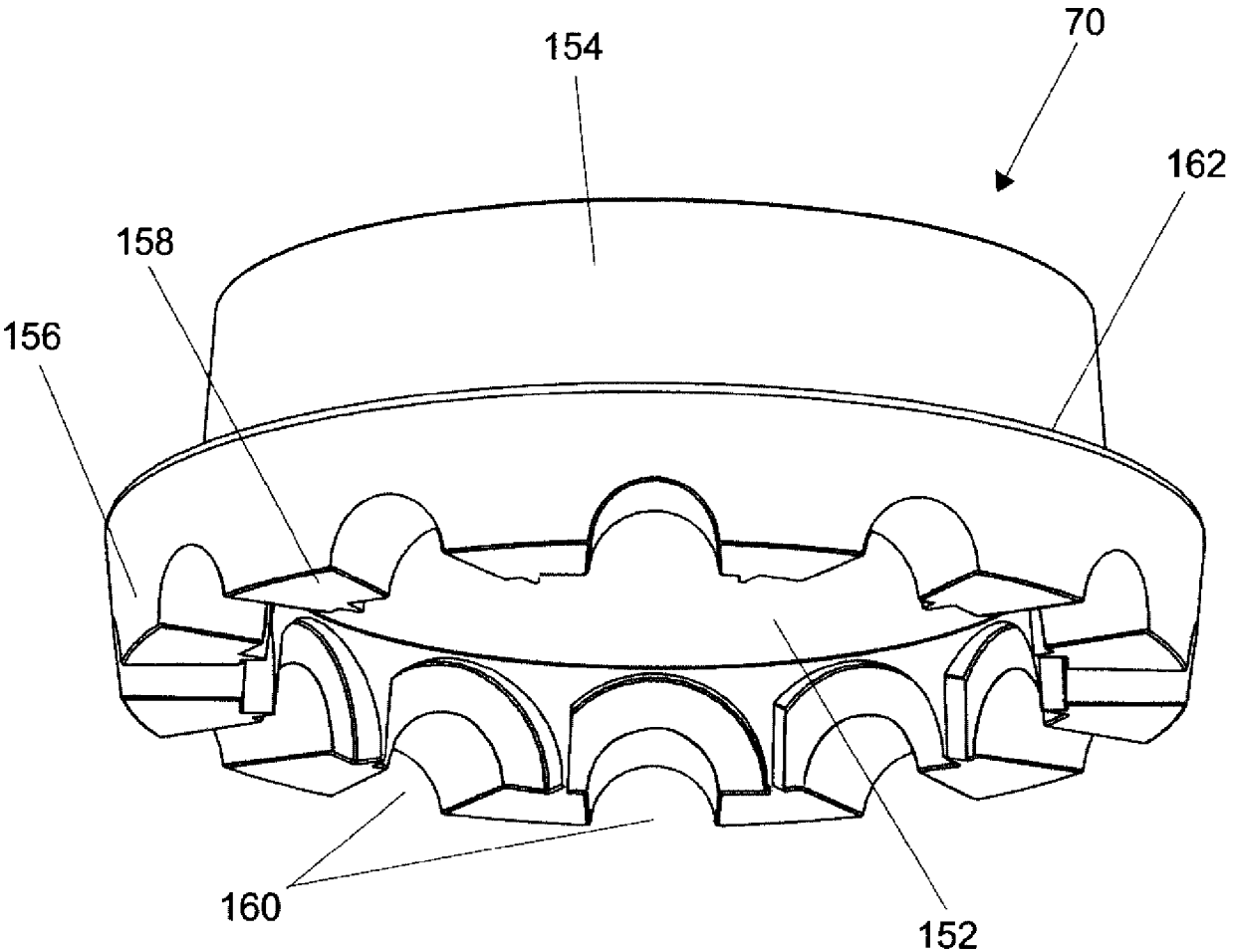

FIGS. 12-13 are top and bottom perspective views, respectively, showing the keeper 70 of FIG. 6 in greater detail. As shown in FIGS. 12-13, the keeper 70 can comprise an annular-shaped member having an inner side 152, an outer side 154, and an outer periphery 156. A bottom section 158 of the keeper 70 may define a number of grooves 160 configured in size and shape to fit about the upper half of each twistlet 72. A flange 162 located about the outer periphery 156 of the keeper 70 is adapted to mate with and receive the inner surface 144 of the split-tube collar 142.

The elbow joint 28 and wrist joint 30 can be configured to operate in a manner similar to the shoulder joint 26, allowing the second armature 18 and wrist joint 30 to each be independently rotated and locked into place at one or more user-defined positions. The elbow joint 28 and wrist joint 30, for example, can each include a bucket handle and bucket, which can be configured to engage several radial grooves on a seat to permit the user to independently lock each of the joints 28,30 at one or more user-defined positions. In some embodiments, the elbow joint 28 and wrist joint 30 may also include a friction bearing that can be used to adjust the force required to rotate the joints 28,30.

Figure 14:
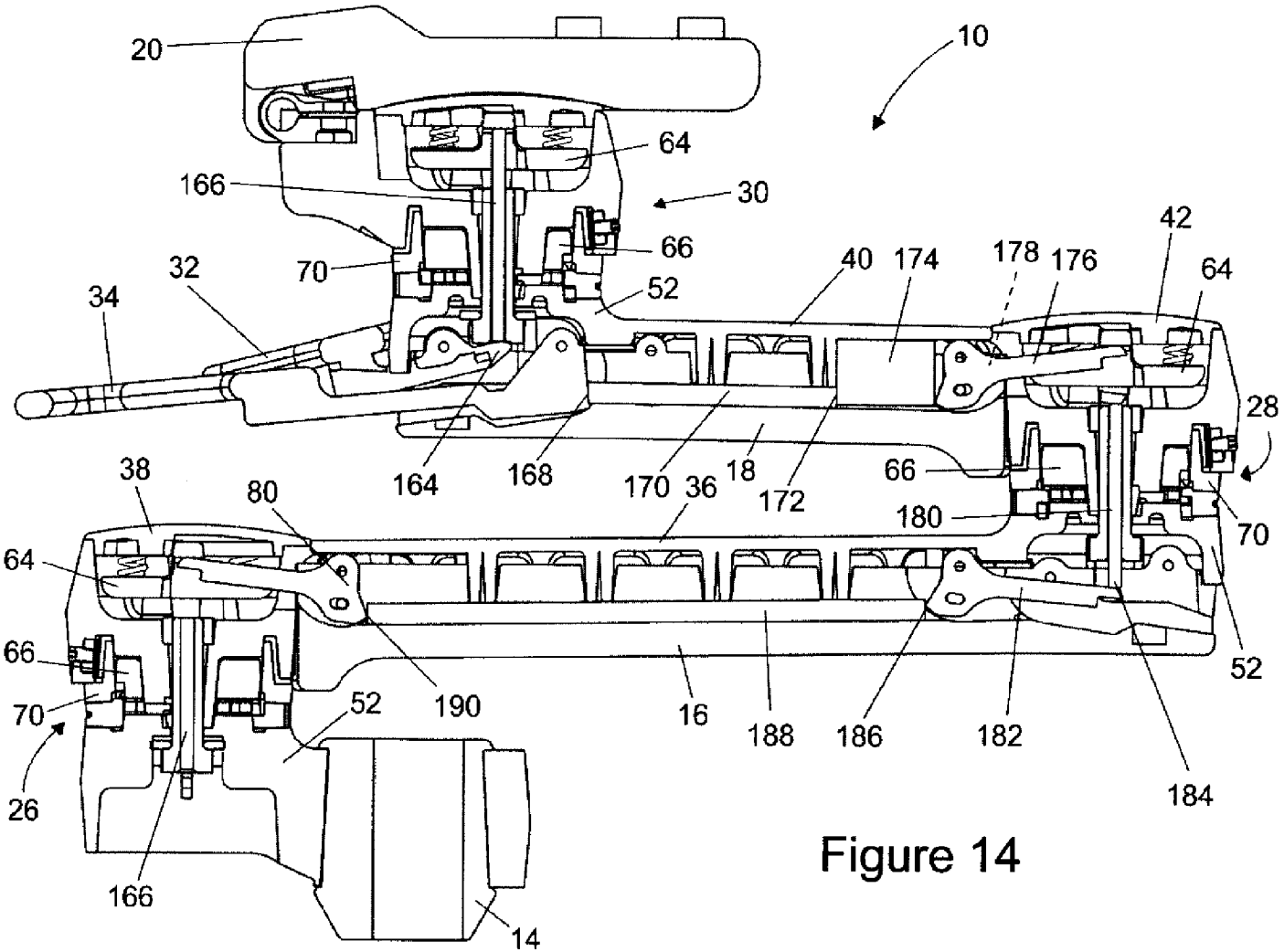
FIG. 14 is a side cross-sectional view showing the positioning apparatus of FIG. 3 in a fully unlocked position.

FIG. 14 is a side cross-sectional view showing the positioning apparatus 10 of FIG. 1 in a fully unlocked position. As depicted in FIG. 14, movement of both of the actuation levers 32,34 in a downward direction causes each of the joints 26,28,30 to unlock, allowing the first and second armatures 16,18 and the platform 20 to be independently moved to a new position. Depression of the first actuation lever 32 in a downward direction, for example, causes a finger 164 on the lever 32 to engage an elongated member 166 within the wrist joint 30, causing the bucket handle 64 within the joint 30 to move upwardly. When this occurs, the bucket 66 becomes disengaged from the seat 52, allowing the wrist joint 30 to be rotated and adjusted to a new position. Actuation of the first actuating lever 32 in this manner can be used, for example, to rotate a tray (not shown) attached to the platform 20 to a different position.

The elbow and shoulder joints 26,28 can each be simultaneously unlocked in a single action by depressing the second actuation lever 34 in a downward direction, as further shown in FIG. 14. Depression of the second actuation lever 34 in this manner causes an engagement surface 168 on the lever 34 to engage a linkage 170 within the housing 40 of the second armature 18. When this occurs, an end 172 of the linkage 170 engages a pusher block 174 disposed within the housing 40, which, in turn, applies a pushing force on two lever arms 176,178 in mechanical communication with the elbow joint 28. The pusher block 174, for example, may apply a pushing force on a first lever arm 176 operatively coupled to the bucket handle 64 within the elbow joint 28, causing the bucket handle 64 to lift upwardly and disengage the bucket 66 from the seat 52.

The pusher block 174 may further apply a pushing force to a second lever arm 178 (partially hidden) located in part within the elbow joint 28. When this occurs, the second lever arm 178 applies a downwardly directed force to an elongated member 180 extending through the bucket handle 64, bucket 66 and keeper 70 of the elbow joint 28. A third lever arm 182 in communication with the lower end 184 of the elongated member 180 can be configured to translate the downwardly directed force applied by the member 180 to the end 186 of a linkage 188 located within the housing 36 of the first armature 16. The force imparted to the opposite end 190 of the linkage is then applied to the lever arm 80 in communication with the shoulder joint 26, causing the bucket handle 64 for that joint 26 to lift and disengage the bucket 66 from the seat 52, as shown.

FIGS. 15-18 are several partial cross-sectional views showing the actuation of a temporary unlocking wedge 194 within the elbow joint 28. As can be seen in a first, fully locked position depicted in FIG. 15, the bucket handle 64 and bucket 66 are in a fully lowered position, with the bucket 66 firmly engaging the seat 52 to prevent rotational movement of the joint 28. In this position, the wedge 194 is disposed within the inset portion 100 of the bucket 66, allowing the bucket 66 to engage the seat 52.

Figure 16:
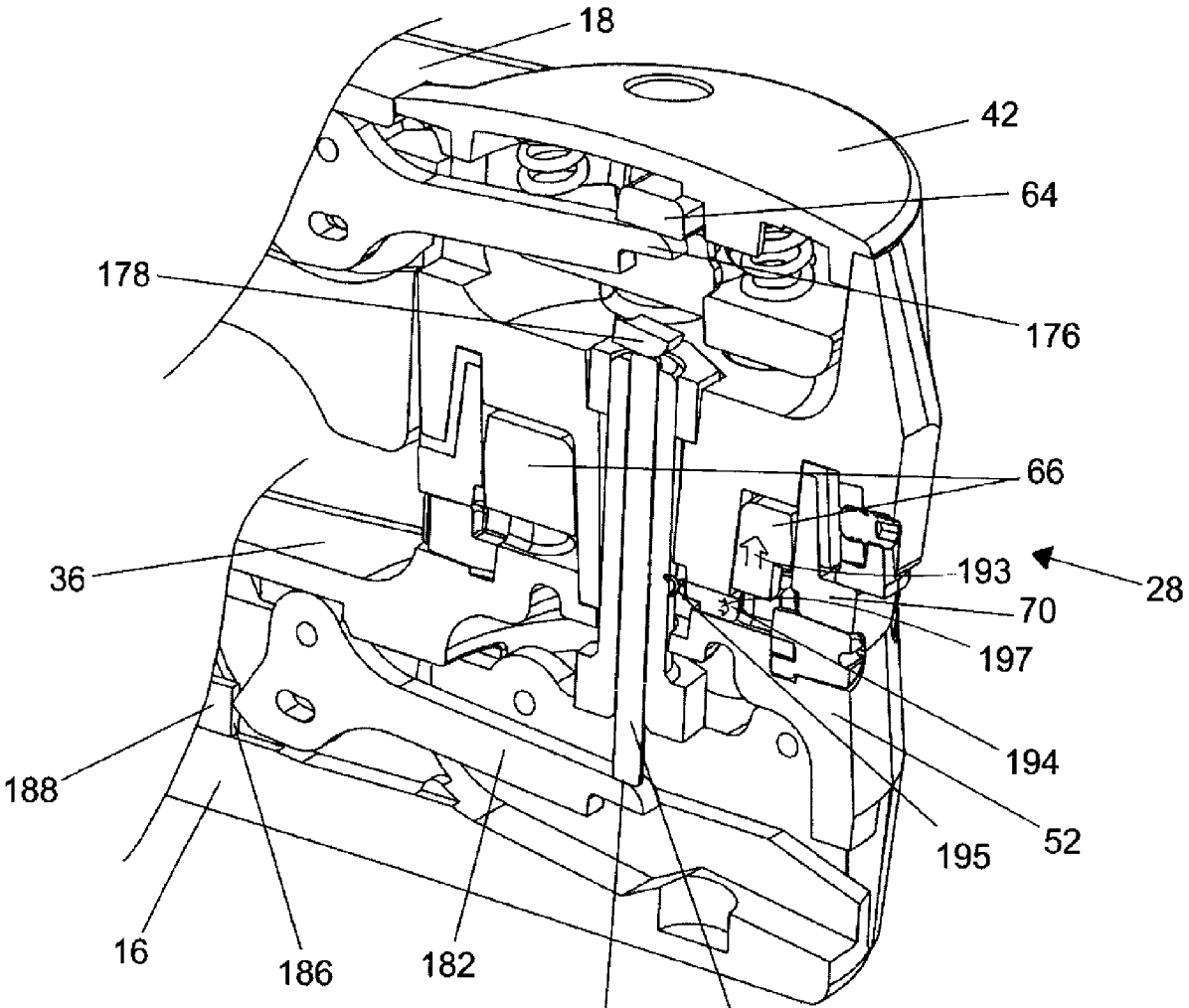

When the actuation lever 34 is engaged in a downward direction, and as further shown in a second view in FIG. 16, the upwardly directed force applied to the bucket handle 64 via lever 176 causes the bucket 66 to move upwardly away from the seat 52 in the direction indicated generally by arrow 193, thus releasing the lock set within the joint 28. When this occurs, the biasing force from a spring 195 forces the wedge 194 to move outwardly, as indicated generally by arrow 197 in FIG. 16. In this position, the location of the wedge 194 within one of the grooves 61 on the seat 52 prevents the bucket 66 from moving downward and engaging the seat 52.

Figure 17:
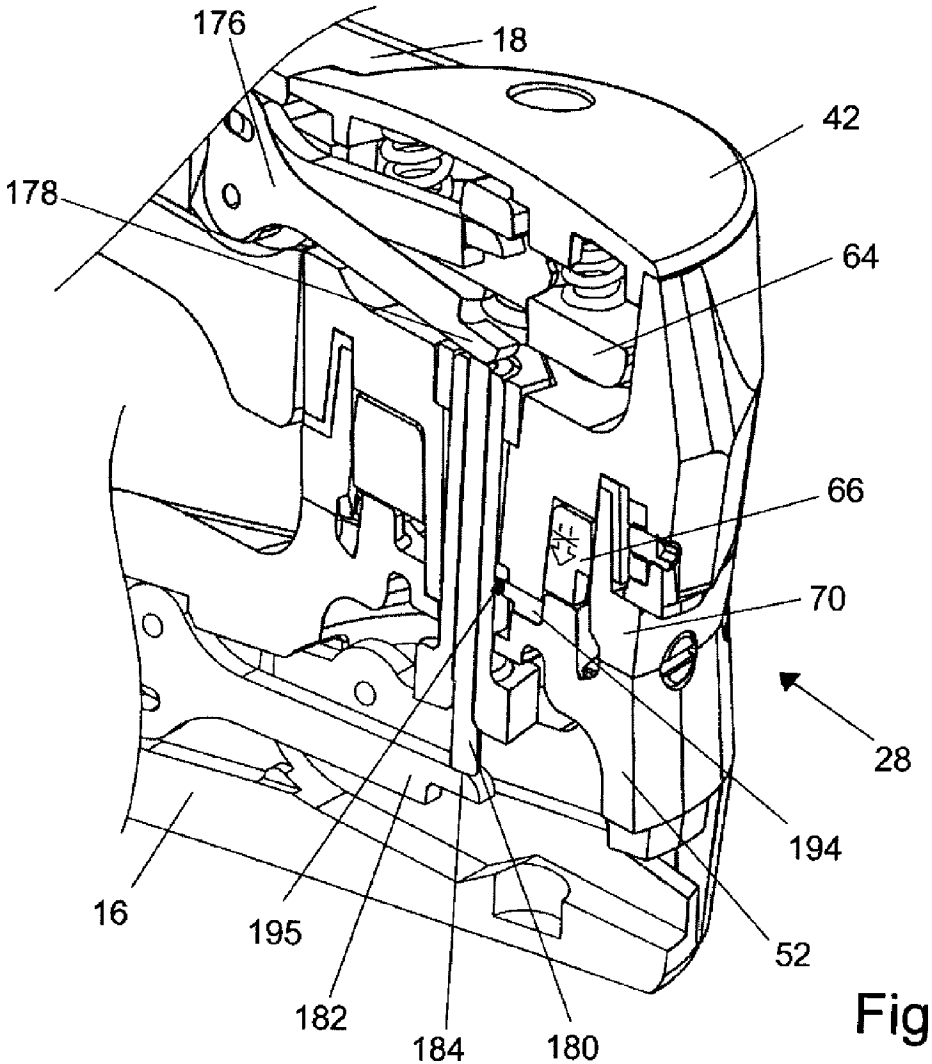
Figure 18:
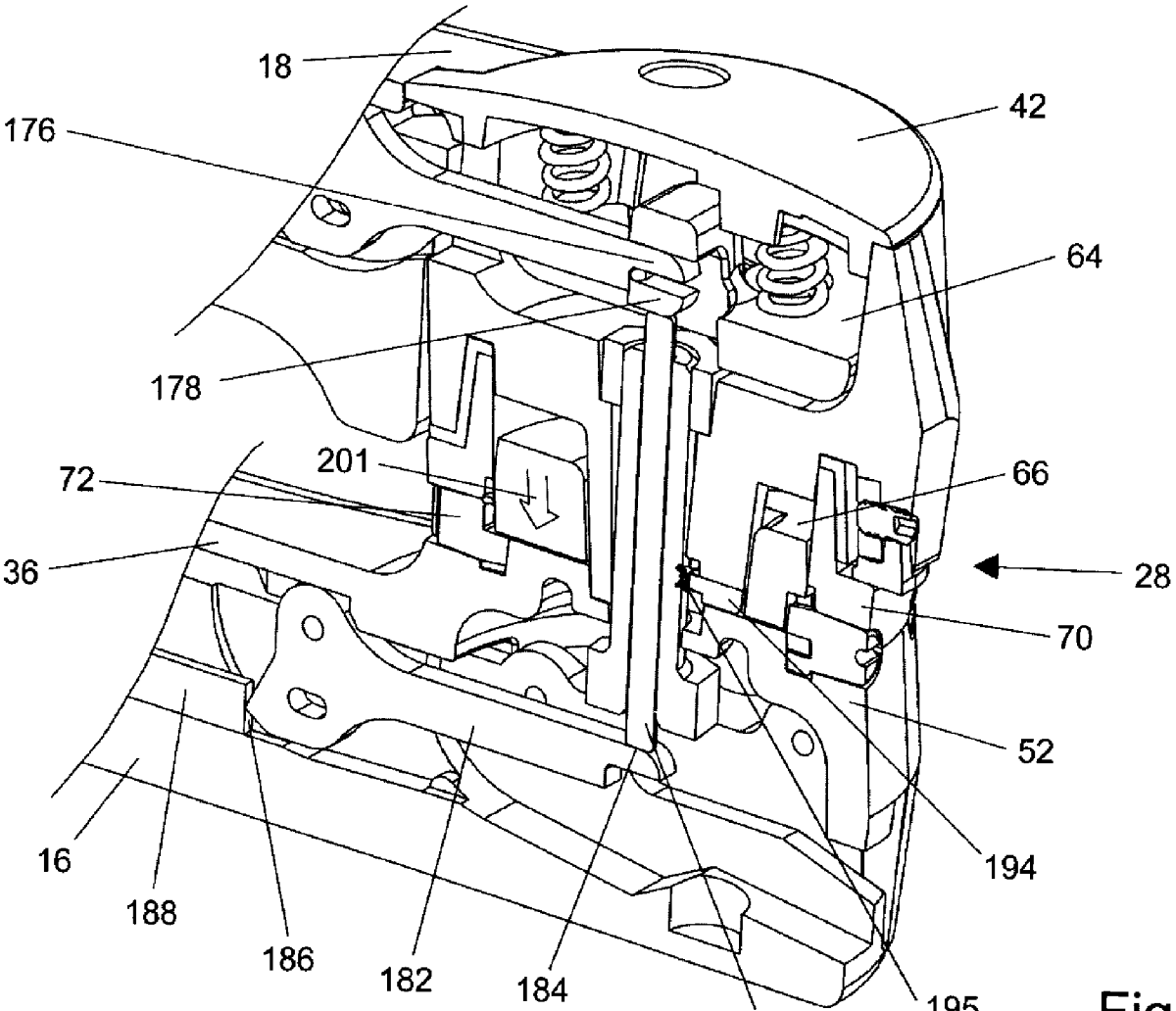

FIG. 17 is another partial cross-sectional view of the elbow joint 28, showing a secondary position of the wedge 194 having been pushed out of the groove 61 of the seat 52 once the bucket 66 is disengaged and the joint 28 has been rotated. As shown in FIG. 17, the leading edge 196 of the wedge 194 (see FIG. 25) can be configured to fit at least in part within one of the grooves 61. In this position, the joint 28 can be indexed to a new position without the bucket 66 being engaged. If the user desires to set one or more locks on the joint 28, the user may set one or more of the twistlets 72 to an engaged position by inserting a screwdriver head into a slot 200 on the desired twistlet 72, and then rotating the twistlet 72 in a clockwise direction approximately 90°. Further rotation of the joint 28 pushes the wedge 194 back to a point where the bucket 66 is able to drop when it reaches a lock position, as further indicated generally by arrow 201 in FIG. 18.

The twistlets 72 may each include a finger that, upon rotation of the twistlet 72, blocks the groove 58 preventing the tooth face of the bucket 66 from allowing the bucket 66 to drop. As can be seen further in FIG. 19, for example, the rear of the twistlet 72 can include a finger 202 that, when the twistlet 72 is rotated via a screwdriver, can be configured to extend inwardly within the groove 58 preventing the tooth 105 of the bucket 66 from moving within the groove 58, thus keeping the bucket 66 from springing back to its engaged or locked position against the seat 52 and preventing rotation of the joint 28. The engagement of the finger 202 can be subsequently released by rotating the twistlet 72 in an opposite direction (i.e. counterclockwise). In use, the twistlets 72 can be used to set the joints 26,28,30 to enable one or more user-defined locking positions, allowing the user to easily and quickly move the positioning apparatus 10 to another desired position.

The actuation of the wedge 194 and twistlets 72 may be further understood by reference to FIGS. 20-23, which illustrate the actuation sequence of the bucket 66. As depicted in a first, locked position in FIG. 20, the bucket 66 is shown fully engaged onto the seat 52 with the twistlet 72 is rotated into an open position such that the finger 202 of the twistlet 72 is flush with the seat 52. In this position, the wedge 194 (hidden) is contained within the inset 100 of the bucket 66.

Figure 21:
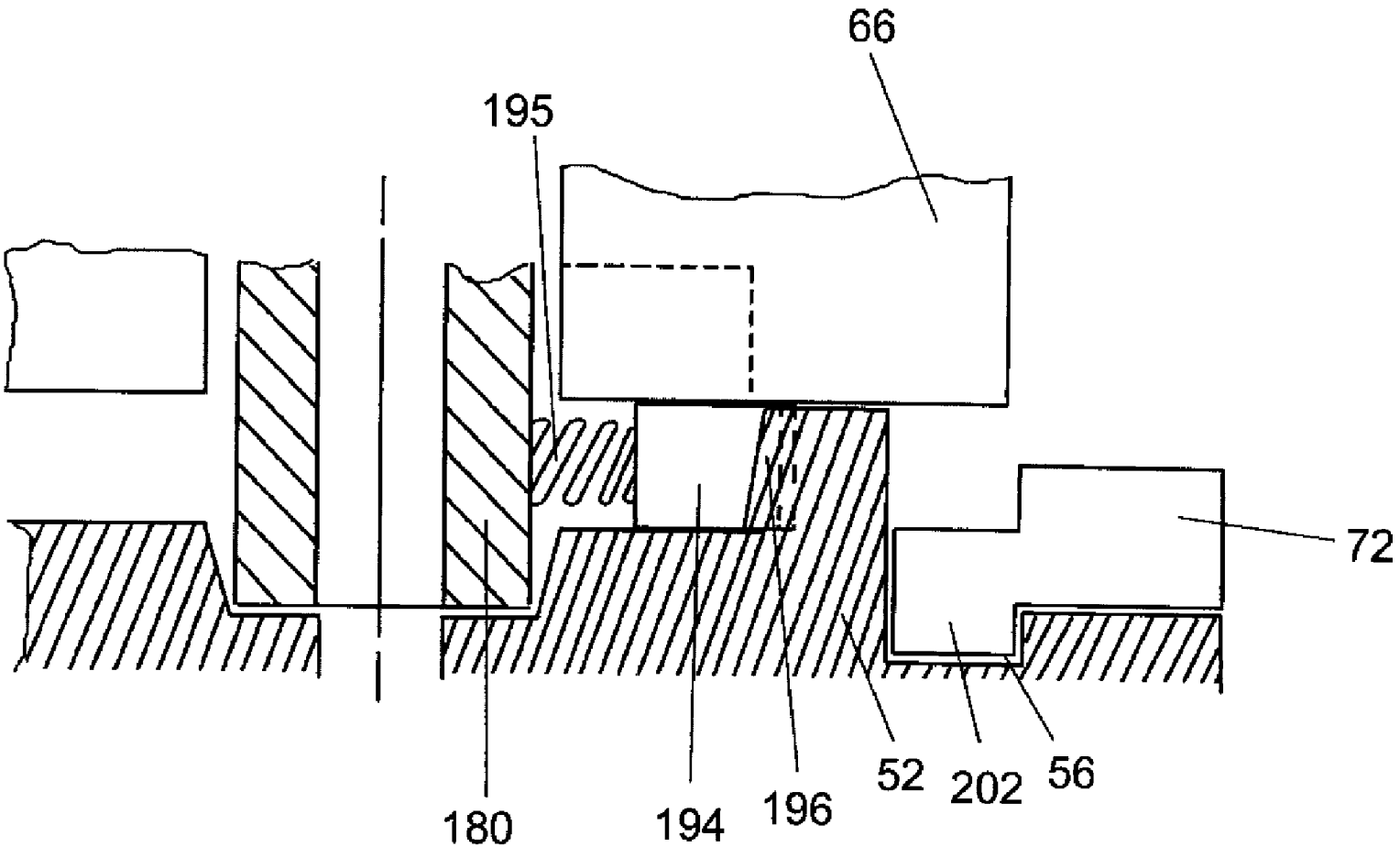
Figure 22:
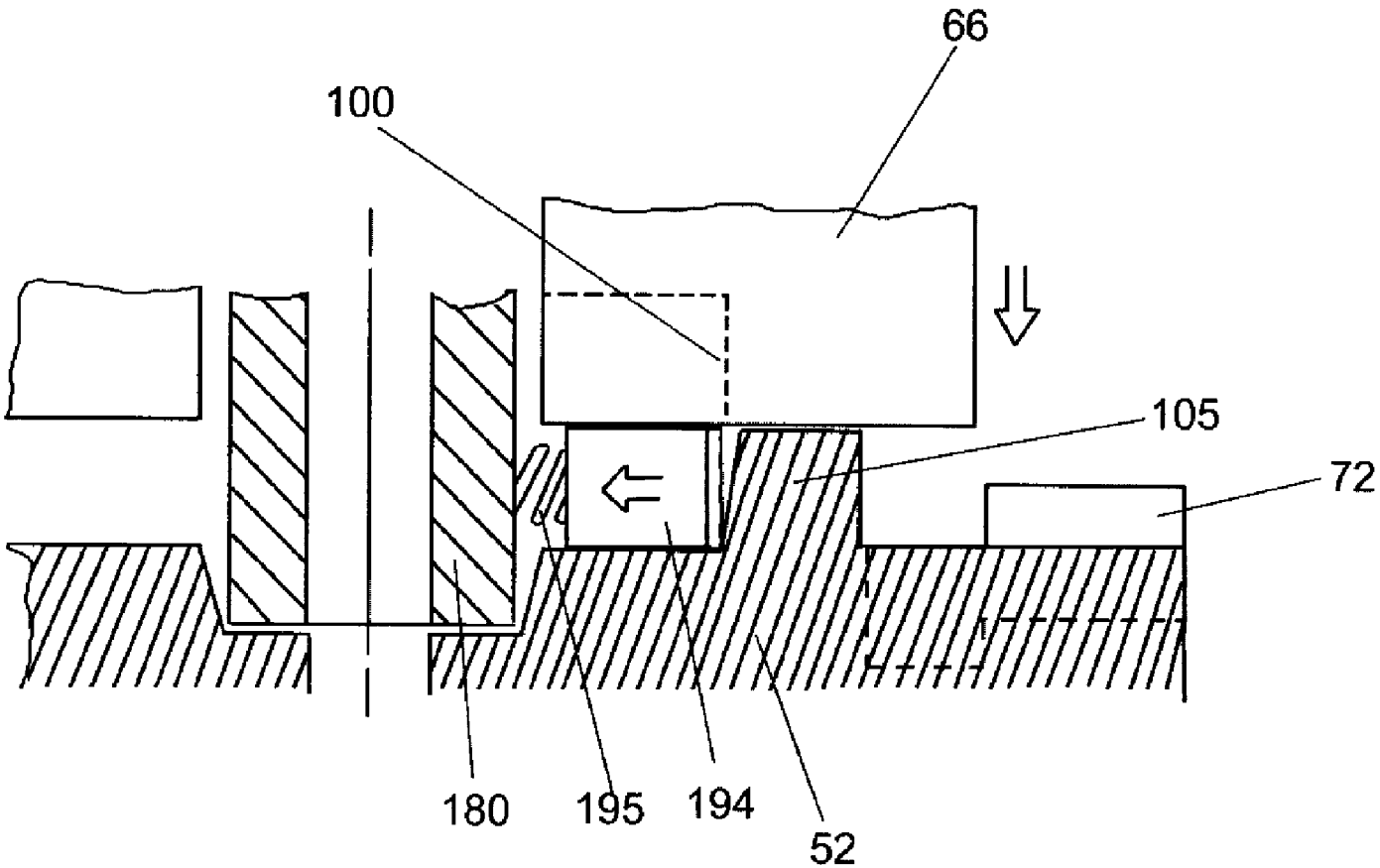
Figure 23:
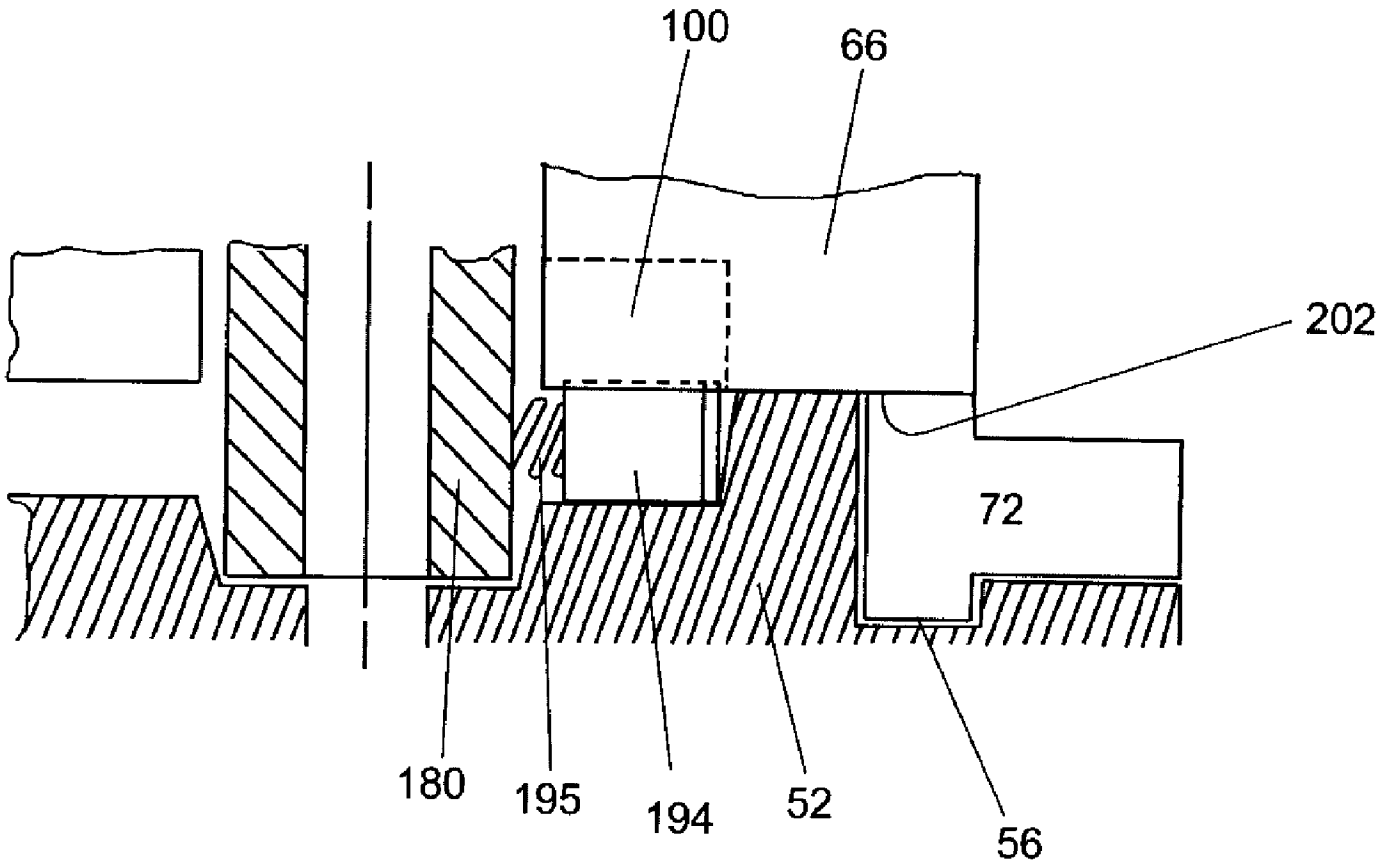

FIG. 21 is a diagrammatic view showing the joint in a temporarily unlocked position. As shown in FIG. 21, actuation of the lever 34 causes the bucket 66 to lift upwardly away from the seat 52, allowing the wedge 194 to move outwardly and occupy the groove 61. In this position, the leading edge 196 of the wedge 194 prevents the bucket 66 from returning to the position depicted in FIG. 20, thus temporarily unlocking the joint and allowing movement of the bucket 66.

Figure 24:
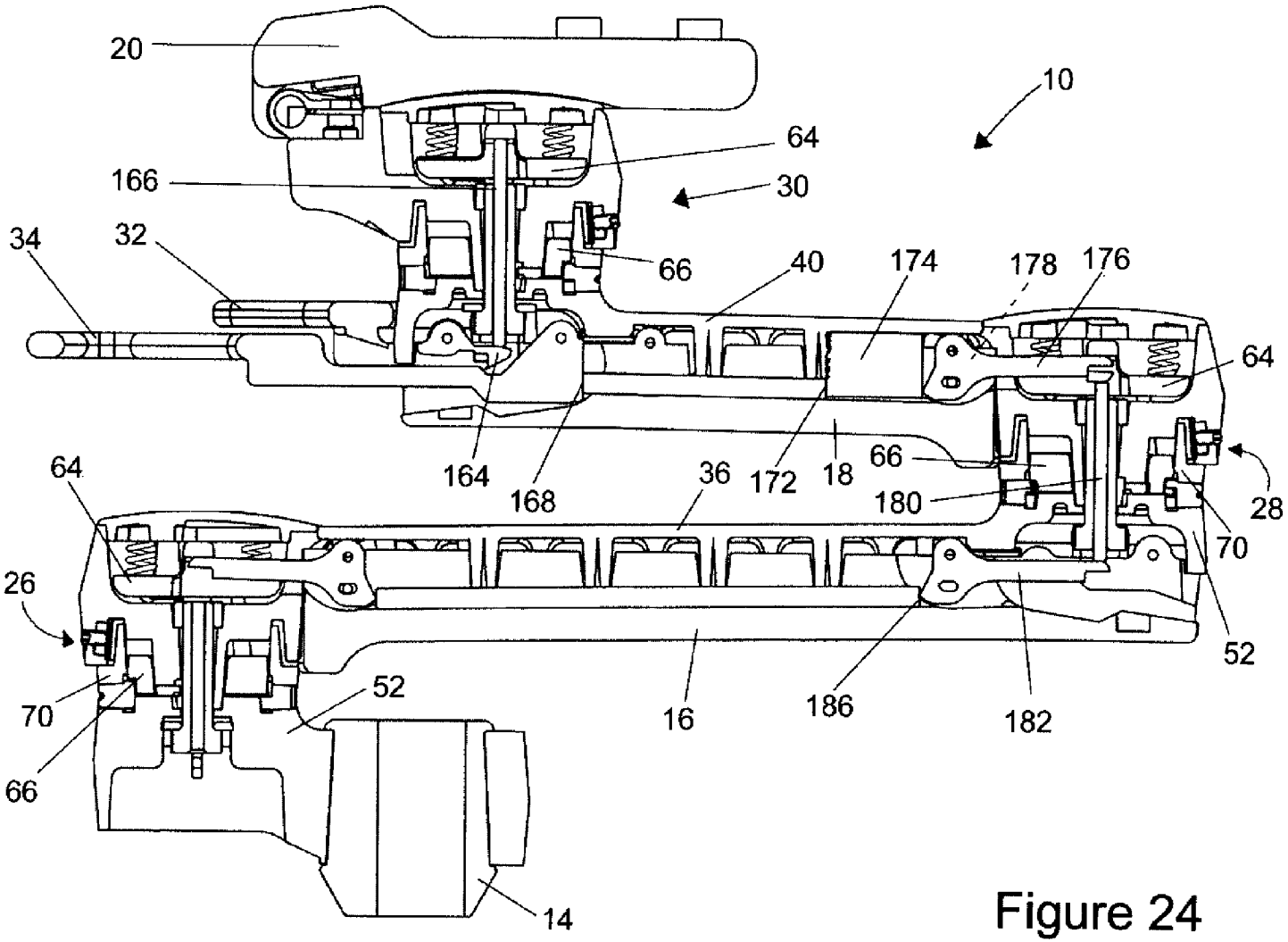
FIG. 24 is a side cross-sectional view showing the positioning apparatus of FIG. 3 in a fully locked position.

As the bucket 66 is rotated a half step (e.g. 15°), the wedge 194 can be configured to slide inwardly, due to the leading edge 196 of the wedge 194 and engagement surface 62 against which it moves. The wedge 194 thereby moves to a first position aligned with the inset portion 100 of the bucket 66, as further shown in FIG. 22. When this occurs, and as can be further seen in FIG. 23, the bucket 66 drops into position on top of the tooth 105, allowing the bucket 66 to seek for another locked position as set by the twistlets 72. In this position, the tooth 105 on the bucket 66 seeks for any open twistlets 72 as the joint is rotated. When the tooth 105 finds an open groove 61, the bucket 66 may then drop to a second position and lock into position against the seat 52. When this occurs, the spring force of the bucket 66 causes the actuation levers 32,34 move upwardly back into the locked position depicted, for example, in FIG. 24.

Figure 25:
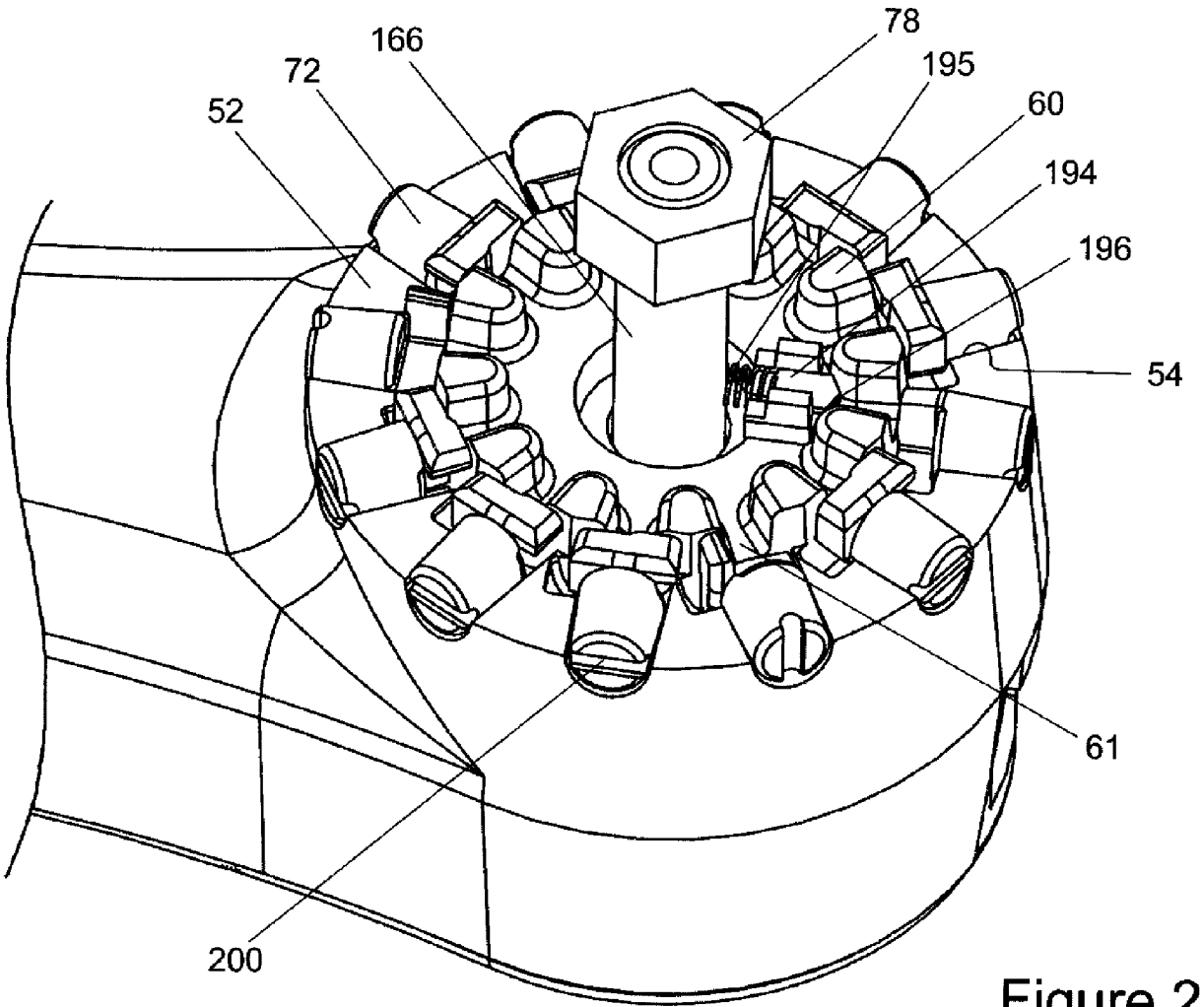
FIGS. 25-26 are several views showing the movement of the wedge as the bucket is being rotated.
Figure 26:
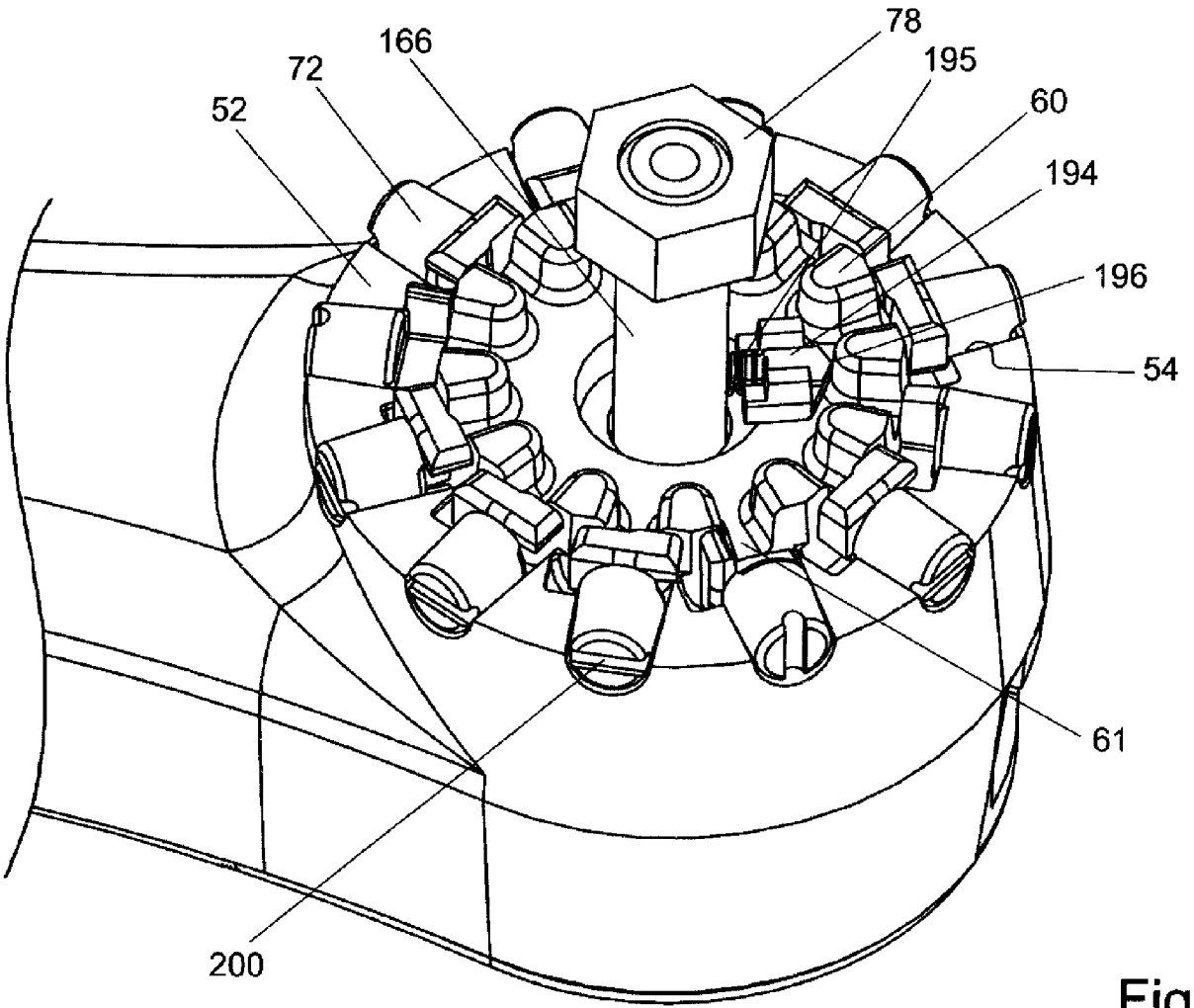
Figure 27:
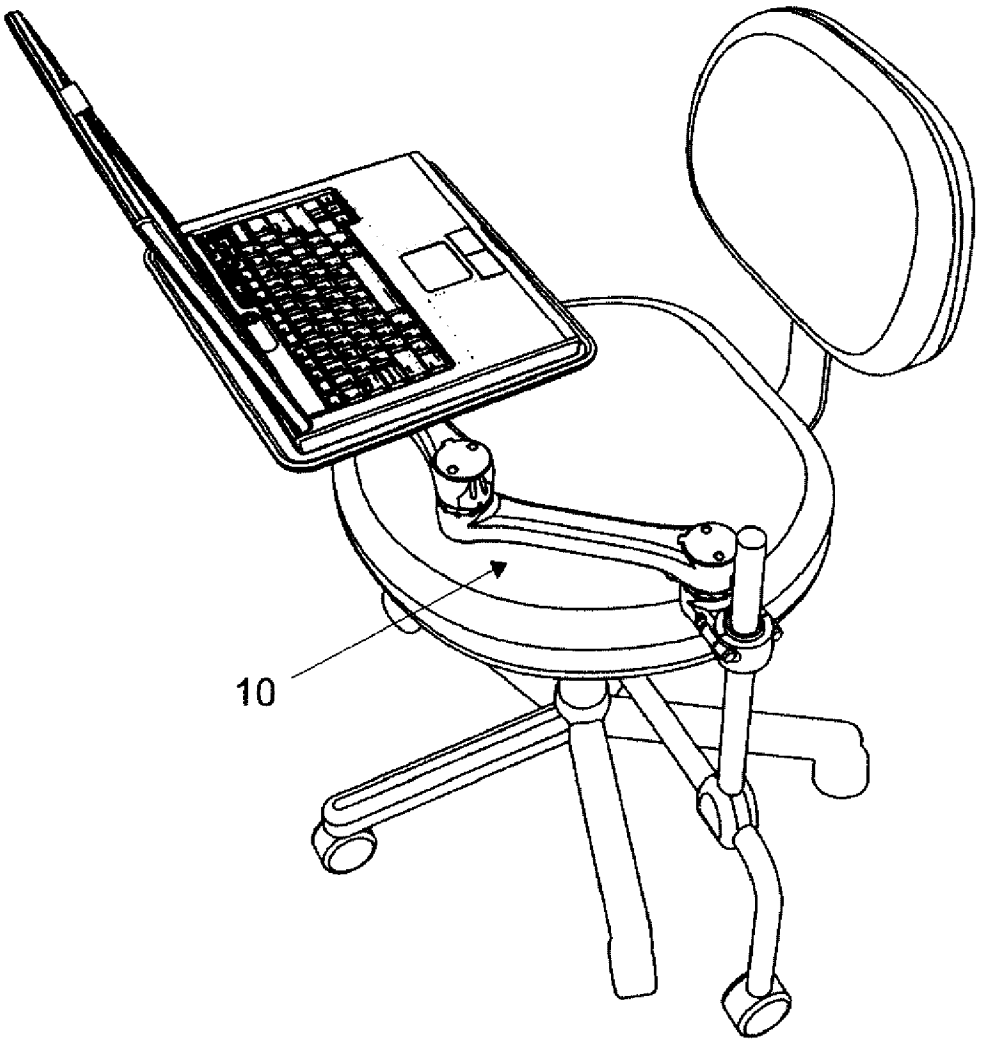
FIG. 27 is a perspective view showing the positioning apparatus of FIG. 3 attached to a chair.
Figure 28:
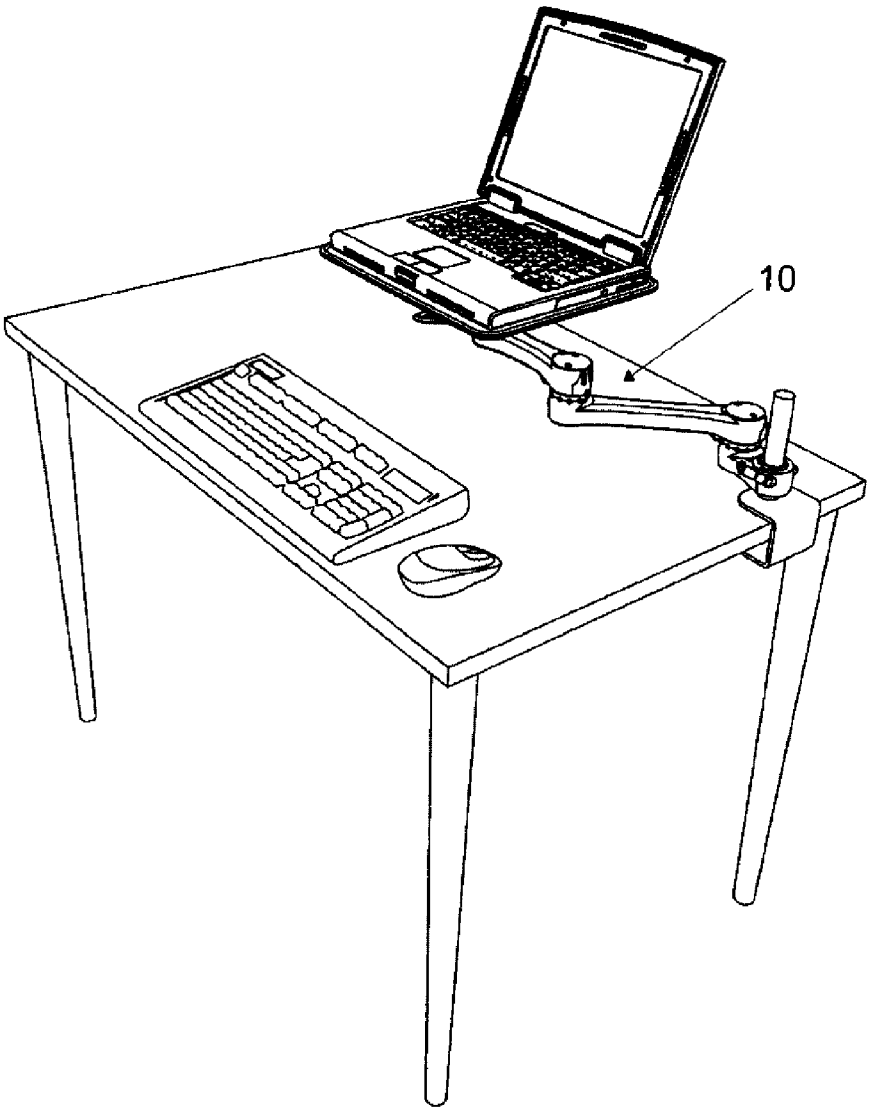
FIG. 28 is a perspective view showing the positioning apparatus of FIG. 3 attached to a table.
Figure 29:
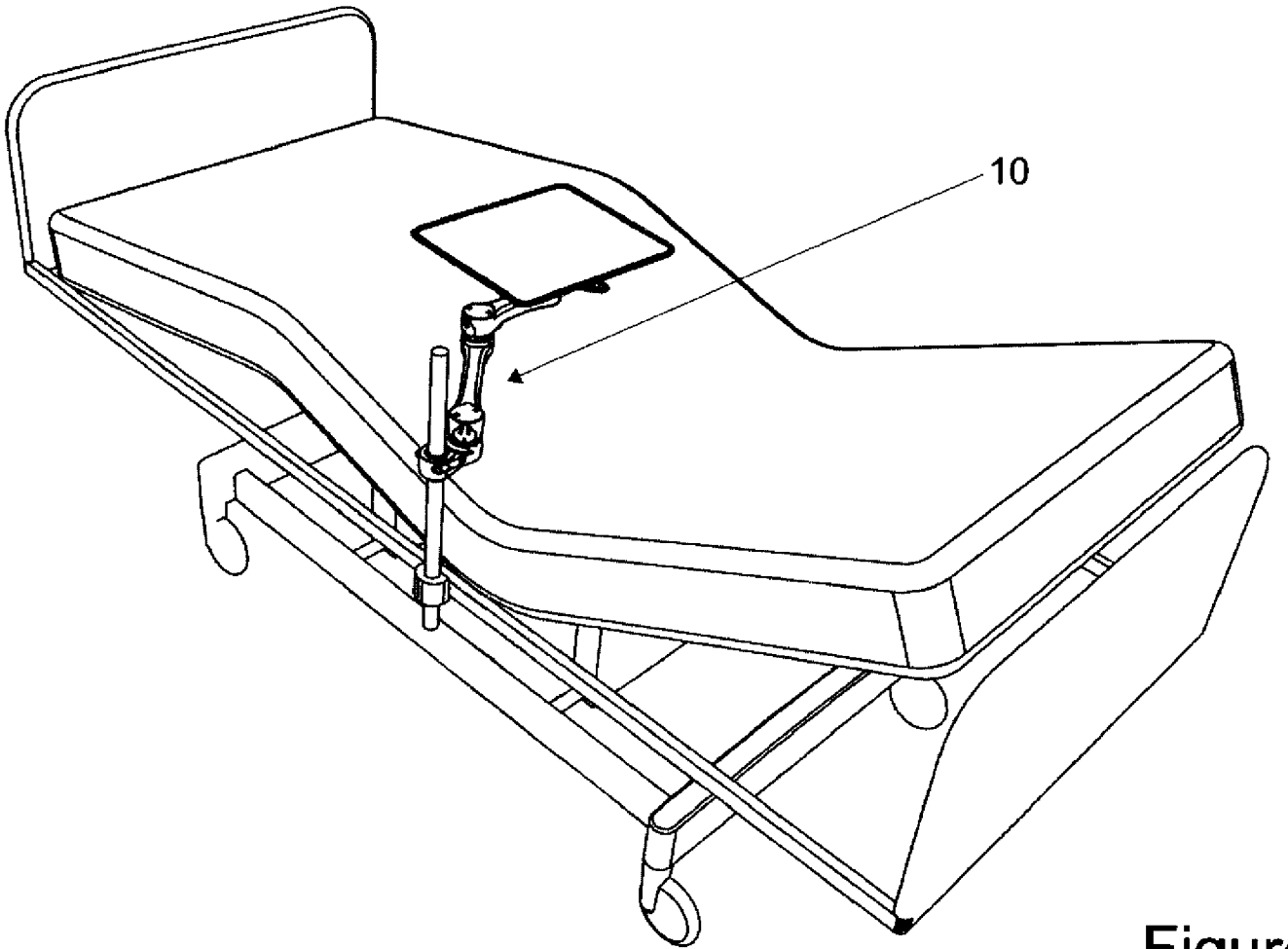
FIG. 29 is a perspective view showing the positioning apparatus of FIG. 3 attached to a hospital bed.
Figure 30:
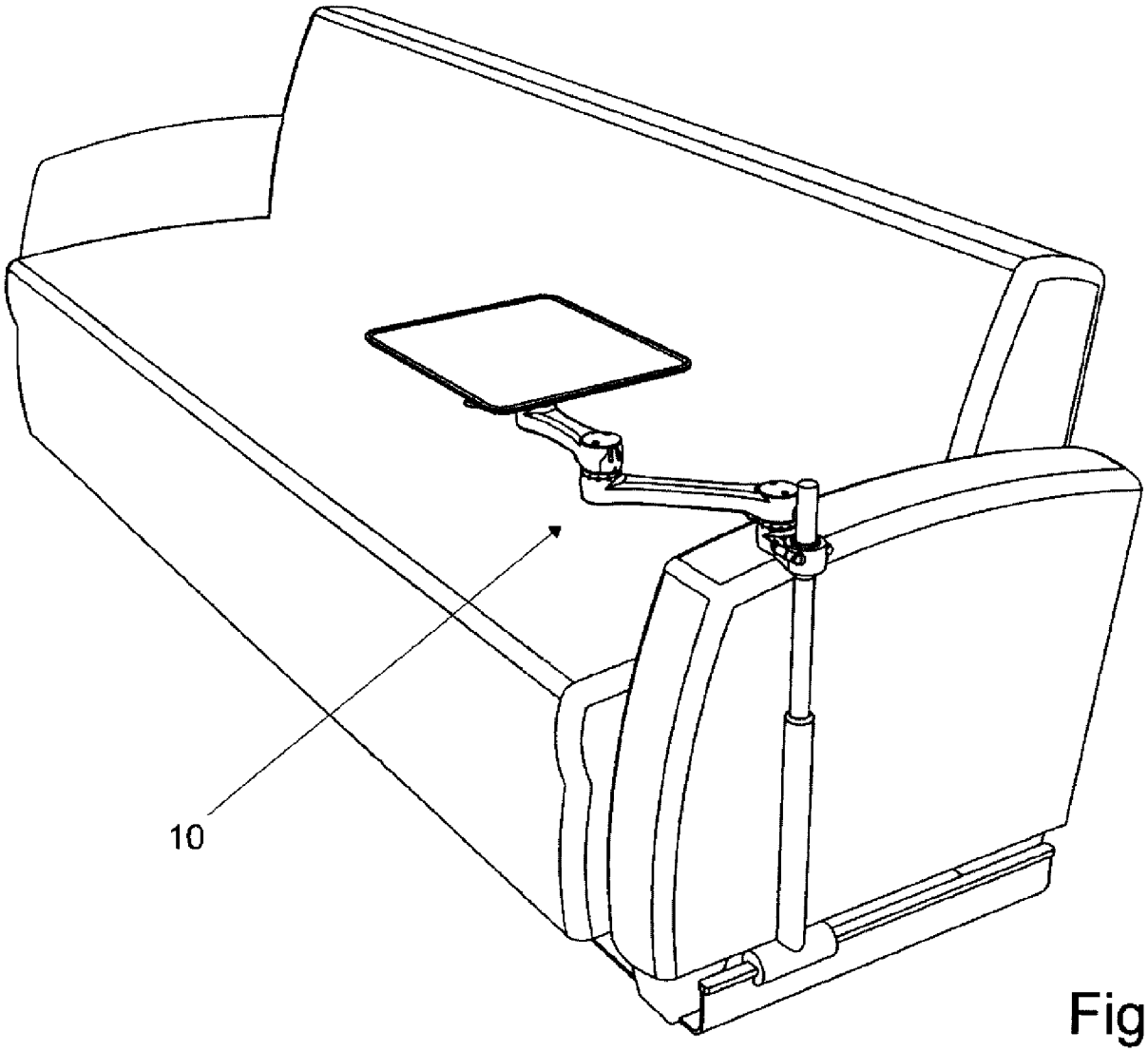
FIG. 30 is a perspective view showing the positioning apparatus of FIG. 3 attached to a sofa.

FIGS. 25 and 26 are views showing the movement of the wedge 194 as the bucket 66 is being rotated. As shown in a first view depicted in FIG. 25, the spring 195 can be configured to bias the leading edge 196 of the wedge 194 into the grooves 61 located between the guide tabs 60 when the bucket 66 (not shown) is lifted by actuation of the release lever 34. FIG. 25 may correspond, for example, to the position depicted generally in FIG. 21.

As can be seen in another position depicted in FIG. 26, rotation of the bucket 66 a half step causes the wedge 194 to move inwardly and compress the spring 195. In this position, the leading edge 196 of the wedge 194 indexes over and engages the surface 62 of the guide tab 60. Such position may correspond, for example, to the position depicted generally in FIG. 22.

Although a wedge 194 may be used for temporarily preventing the bucket 66 from dropping and engaging the seat 52, it should be understood that other temporary unlocking members may be utilized. In one alternative embodiment, for example, a spring loaded ball bearing or pin may be used to prevent the bucket 66 from dropping and engaging the seat 52.

Figure 31:
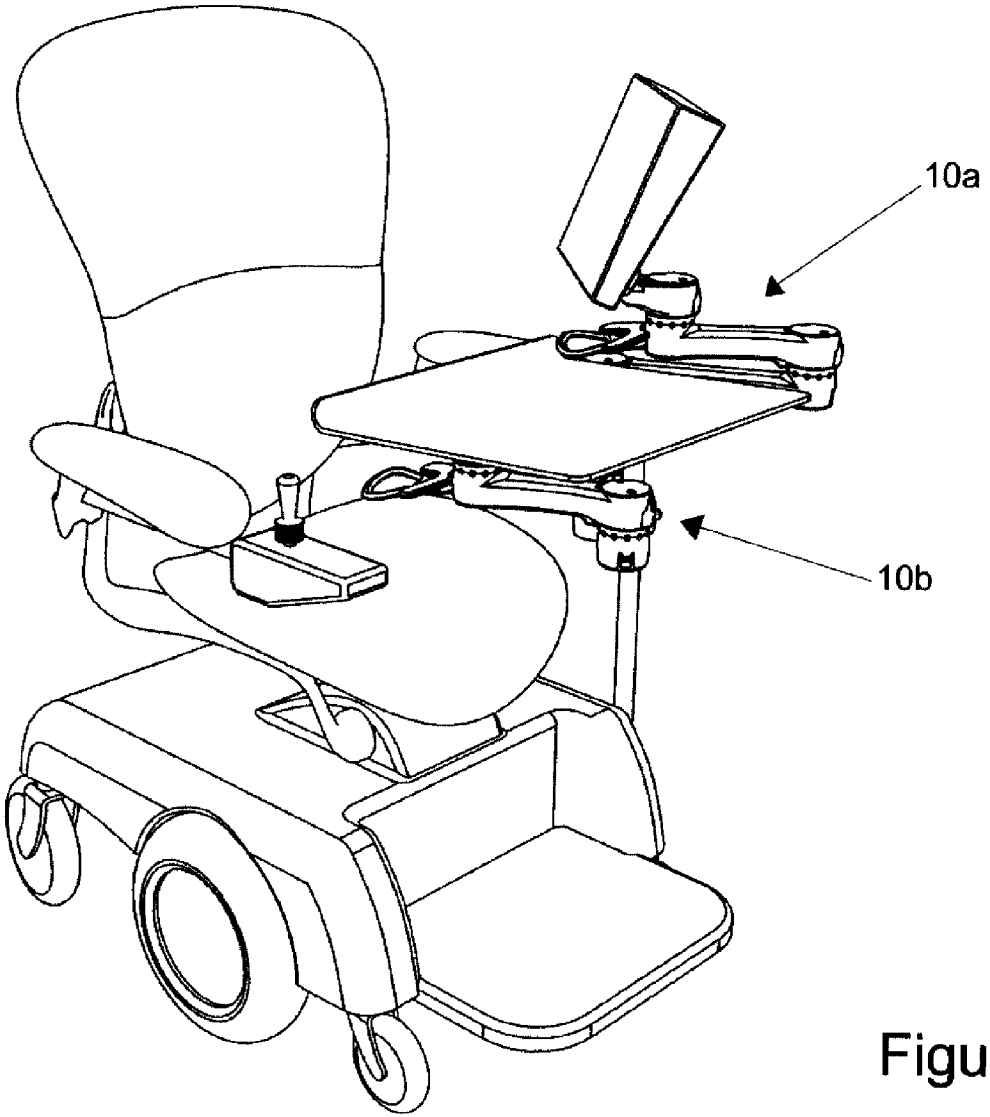
FIG. 31 is a perspective view showing several positioning apparatuses attached to a wheelchair.

The positioning apparatus 10 can be mounted to any number of different devices for holding and/or transporting desired items. FIGS. 27-30 depict several alternative devices upon which the positioning apparatus 10 can be mounted, including, for example, a chair, a table, a hospital bed, and a sofa. It should be understood, however, that the positioning apparatus 10 can be attached to other devices and used in other ways for storing and/or transporting items. In one alternative embodiment depicted in FIG. 31, for example, multiple positioning apparatuses 10*a*,10*b* can be used for storing and/or transporting items. The positioning apparatuses 10*a*,10*b* can be attached to the device via a single base unit, or can be attached to the device using multiple base units. Other mounting configurations are, of course, possible.

Figure 32:
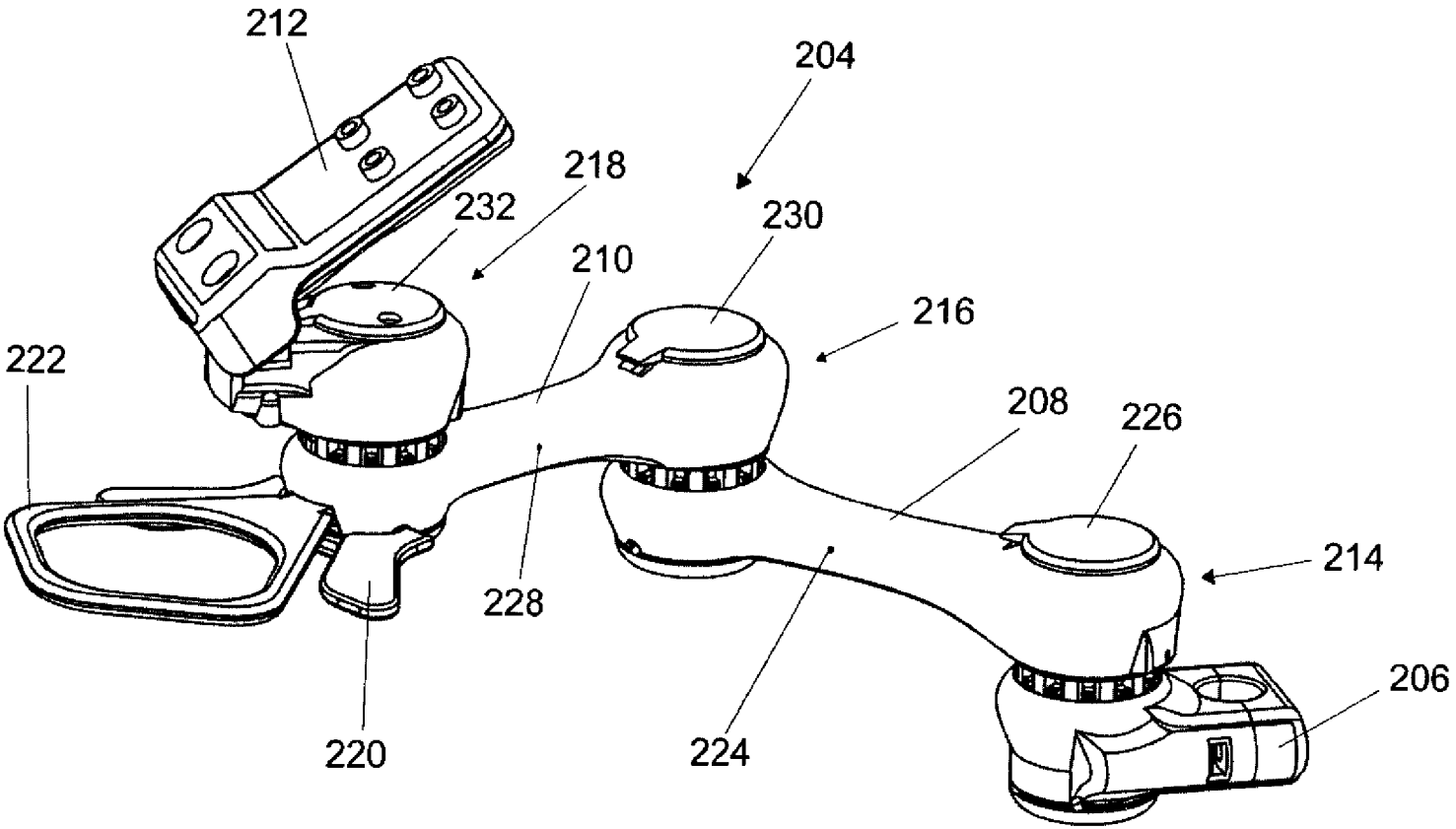
FIG. 32 is a perspective view of a positioning apparatus in accordance with another illustrative embodiment.

Referring now to FIG. 32, a positioning apparatus 204 in accordance with another illustrative embodiment will now be described. As shown in FIG. 32, the apparatus 204 can include a base unit 206, a first armature 208 coupled to the base unit 206, a second armature 210 coupled to the first armature 208, and a tiltable platform 212 coupled to the second armature 210. The first armature 208 can be configured to pivot relative to the base unit 206 via a shoulder joint 214, allowing the apparatus 204 to be moved in a first degree of freedom relative to the base unit 206. The second armature 210, in turn, can be configured to pivot relative to the first armature 208 via an elbow joint 216, allowing the apparatus 204 to be moved in a second degree of freedom relative to the base unit 206. The tiltable platform 212 can be rotatably mounted to the second armature 210 via a wrist joint 218, which can be utilized to rotate the apparatus 204 in a third degree of freedom relative to the base unit 206. In some embodiments, the tiltable platform 212 may further include a mechanism that permits the user to adjust the amount of force required to tilt the platform 212 depending on whether the user is tilting the platform 212 upwardly or downwardly.

The apparatus 204 can be equipped with a number of actuation levers 220,222 that can be used to temporarily unlock the joints 214,216,218 for adjusting the positions of the armatures 208,210 and the platform 212. A first actuating lever 220 of the apparatus 204, for example, can be utilized to temporarily release the wrist joint 218 from an initially locked position, allowing the user to rotate the platform 212 to another desired position. A second actuation lever 222, in turn, can be utilized to simultaneously unlock both the shoulder and elbow joints 214,216, allowing the user to reposition one or both armatures 208,210 to a new position in a single step, if desired.

The first armature 208 can include a housing body 224 and a cap 226, defining a first extension of the apparatus 204 that can be rotated by actuation of the shoulder joint 214. In some embodiments, the shoulder joint 214 can be configured to rotate endlessly one or more times, allowing the first armature 208 to be freely rotated in either a clockwise or counterclockwise direction. Alternatively, and in other embodiments, the shoulder joint 214 can be configured to rotate at an angle in the range of about 0° to 360° relative to the base unit 206, having at least one stop that limits rotation of the joint 214 relative to the base unit 206.

The second armature 210, in turn, can include a housing body 228 and spring cap 230, defining a second extension of the apparatus 204 that can be rotated relative to the first armature 208 by action of the elbow joint 216. As with the shoulder joint 214, the elbow joint 216 can be configured to rotate endlessly one or more times in either a clockwise or counter-clockwise direction, or, alternatively, can be configured to rotate at an angle in the range of about 0° to 360° and then reversed. The armatures 208,210 can each be made from a lightweight material such as an aluminum or zinc alloy in order to reduce the overall weight of the apparatus 204. It should be understood, however, that other types of metals and/or polymeric materials may also be employed.

Although the illustrative embodiment depicted in FIG. 32 includes two independently adjustable armatures 208,210, it should be understood that the apparatus can be equipped with a greater or lesser number of armatures and/or joints, if desired. In some embodiments, for example, the apparatus can be equipped with only a single armature and joint to impart only a single degree of freedom of movement to the apparatus, if desired. Moreover, while the apparatus can include a tiltable platform coupled to a wrist joint, it should be understood that the platform could be configured as a fixed (i.e. non-tiltable) platform, with or without the wrist joint.

Figure 33:
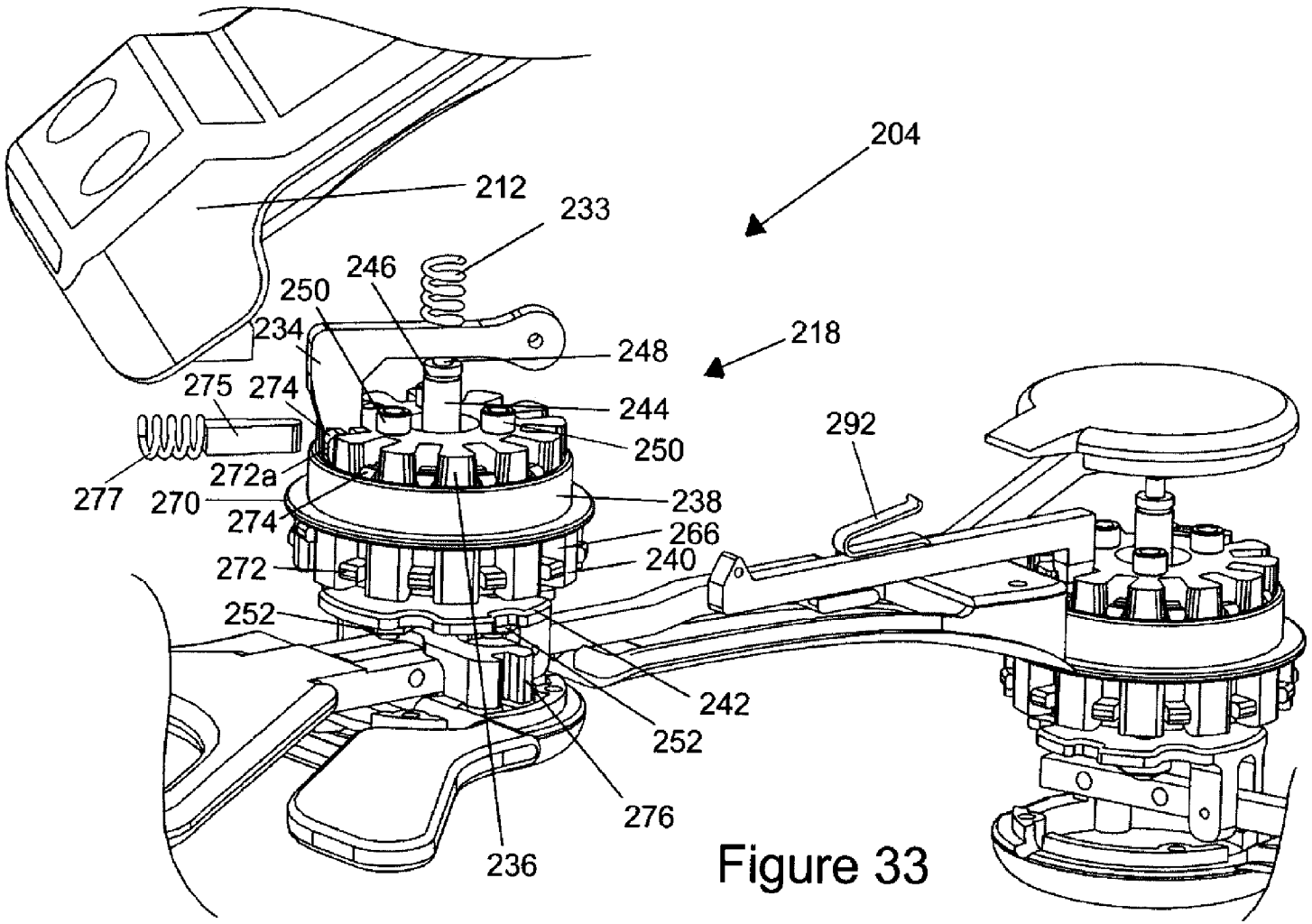
FIG. 33 is a perspective view showing the wrist joint of FIG. 32 in greater detail.

FIG. 33 is an enlarged perspective view showing the wrist joint 218 of FIG. 32 in greater detail. As can be further seen in FIG. 33, the wrist joint 218 can include a spring 233 coupled to the cap 232 (see FIG. 32), a lock lever 234, a lock lever plate 236, a friction bearing 238, a tab body 240, and an actuator plate 242. An elongated member 244 may be used as a retainer to join the two halves of the joint 218 together, and can include an upper end 246 adapted to engage a post 248 on the lock lever 234 when actuated via a yoke 276. In some embodiments, the elongated member 244 can include a smooth, hollow shaft having retaining rings on each end for use in fastening the adjacent armatures together. A number of screws 250 each threadably coupled to a corresponding nut 252, in turn, may be used to secure the lock lever plate 236, friction bearing 238, tab body 240 and actuator plate 242 together, as shown.

Figure 34:
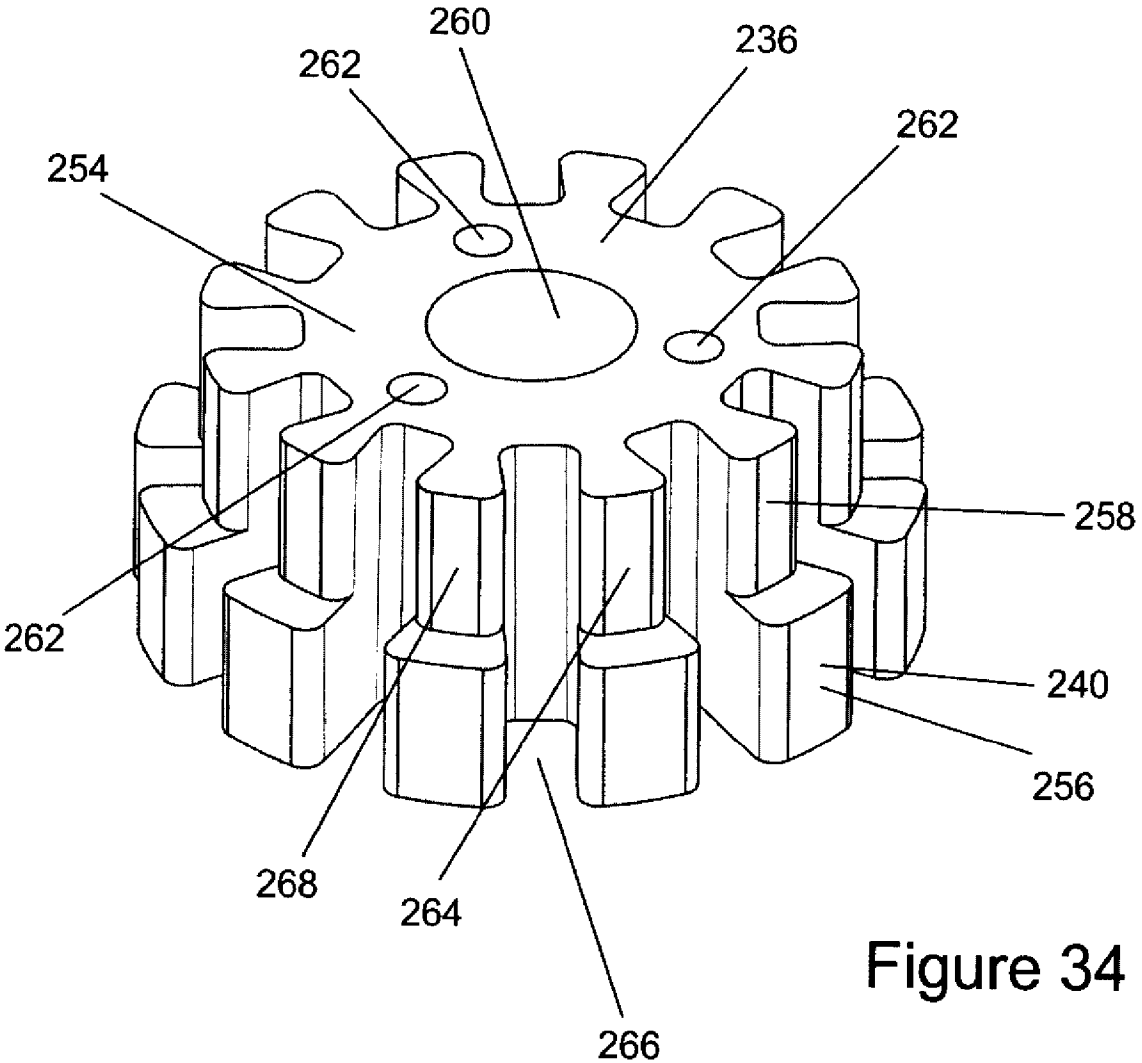
FIG. 34 is a perspective view showing the lock lever plate of FIG. 33 in greater detail.

FIG. 34 is a perspective view showing the lock lever plate 236 and tab body 240 of FIG. 33 in greater detail. As shown in FIG. 34, the lock lever plate 236 may comprise a circular-shaped member having a top section 254, a bottom section 256, and an outer periphery 258. A central opening 260 disposed through the interior of the lock lever plate 236 and tab body 240 is configured to slidably receive the elongated member 244 and post 248 depicted in FIG. 33. A number of other openings 262, in turn, are configured to receive the screws 250 depicted in FIG. 33 for securing the lock lever plate 236 to the friction bearing 238, tab body 240, and the actuator plate 242.

The outer periphery 258 of the lock lever plate 236 may further define a number of outwardly extending ridges 264, forming a number of grooves 266 radially disposed about the outer periphery 258. In certain embodiments, for example, the outer periphery 258 of the lock lever plate 236 may include 12 radial grooves 266, which, during adjustment, allow the user to set potential joint 218 lock positions at 30° radial increments. It should be understood, however, that the lock lever plate 236 may include a different number of grooves 266 to permit the joint 218 to be indexed at other radial increments, if desired.

A reduced-diameter portion 268 on the outer periphery 258 of the lock lever plate 236 forms a flange adapted to mate with and receive a corresponding flange 270 (see FIG. 33) on the friction bearing 238. In use, the friction bearing 238 can be configured to assert a friction force on the outer periphery 258 of the lock lever plate 236 that impedes motion of the plate 236. If desired, a set screw and friction plate can be used to adjust the frictional force applied to the friction bearing 238, which in turn, impedes rotation of the joint 218.

As can be further seen by reference back to FIG. 33, a number of tabs 272 movably disposed within the grooves 266 can be used to set the joint 218 at one or more user-defined positions, allowing the user to easily and quickly reposition the apparatus 204 to one or more desired positions. The tabs 272, most of which are shown in a potential lock (i.e. down) position in FIG. 33, can each be independently advanced upwardly within their corresponding groove 266. In the illustrative view depicted in FIG. 33, one of the tabs 272*a* is shown advanced upwardly within its groove 266. In this position, the leading end 274 of the tab 272*a* extends upwardly and lies flush with the top section 254 of the lock lever plate 236, allowing the lever 234 to glide over the tab 272*a* and thus prevent the lever 234 from dropping and locking the joint 218. The remaining tabs 272 may be similarly advanced upwardly in their respective groove 266 to prevent the lever 234 from dropping and locking the joint 218 at other desired locations.

As the joint 218 is rotated over the grooves in which the tabs 272 are in the down position, the lever 234 will drop and cause the joint 218 to lock. When the actuator 222 or 220 is activated to release a locked joint, an external lock-out member 275 biased towards the outer periphery 258 of the tab body 236 via a spring 277 allows the joint 218 to remain unlocked until the user moves the joint 218 one half of one position (e.g. 15°). The lock-out member 275 is forced out of the groove 266 with the rotation. Such a feature may be used, for example, to facilitate adjustment of the joint 218 with a single hand. The first and second joints 214,216 can each be configured to operate in a manner similar to the wrist joint 218, allowing the first and second armatures 208,210 to be independently rotated and locked into various positions, as desired.

Figure 35:
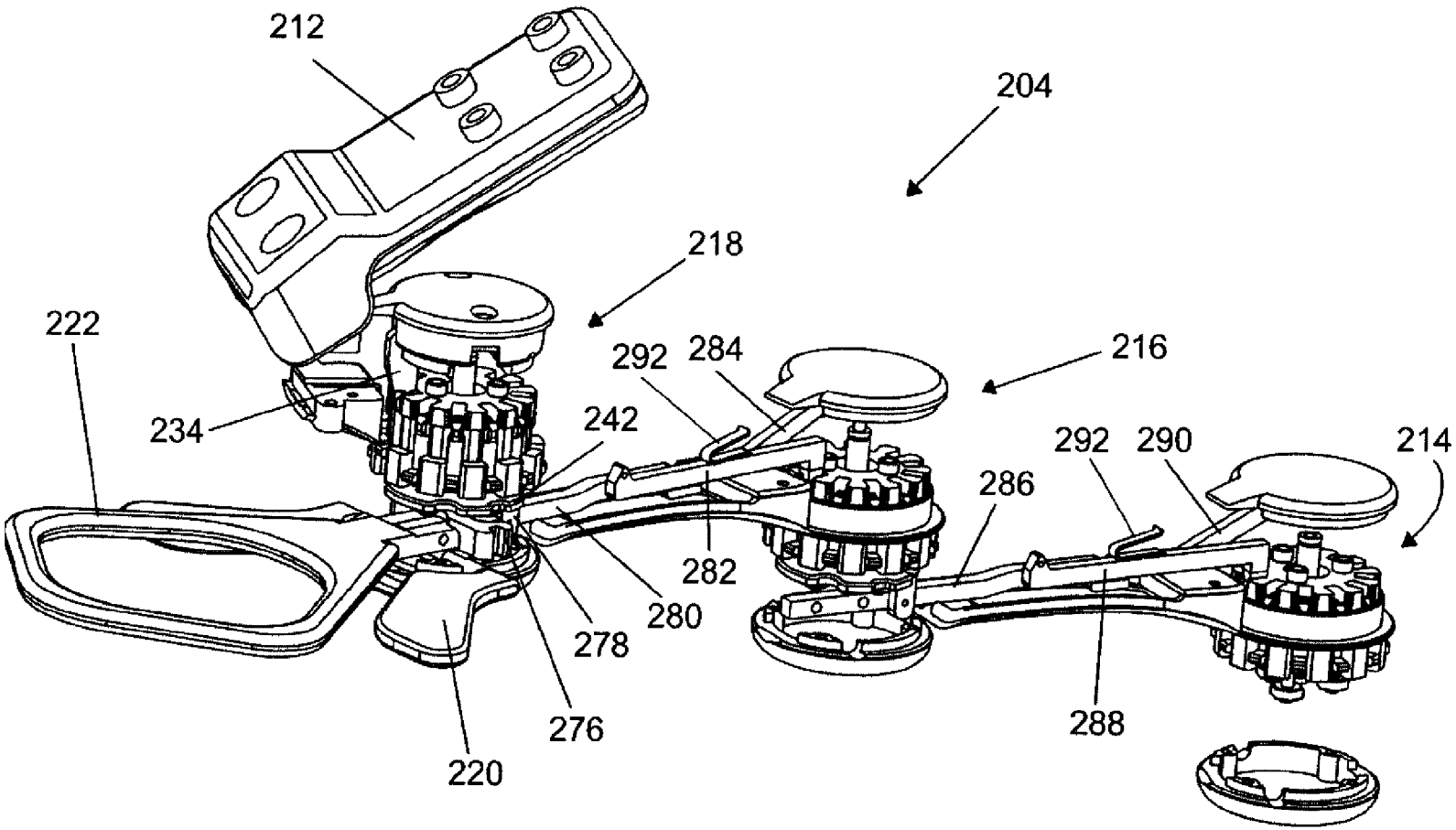
FIG. 35 is a side cross-sectional view showing the positioning apparatus of FIG. 32 in a fully locked position.

FIG. 35 is a side cross-sectional view showing the positioning apparatus 204 of FIG. 32 in a fully locked position. As can be further seen in FIG. 35, the first actuation lever 220 may be operatively coupled to a yoke 276. When the actuation lever 220 is depressed in a downward direction, the yoke 276 lifts the pin 248, which, in turn, lifts the lock lever 234 out of the groove 266 on the tab body 240. When this occurs, the lock-out member 275, which is spring biased inwardly via spring 277, engages a groove 266 on the tab body 240, preventing the joint 218 from locking until, at such point, the lock lever 234 finds another groove 266 that is set in a locked position via a tab 272. When the lock lever 234 finds an open groove 266, the pin 248 is forced downwardly via the spring 233, which, in turn, forces down the yoke 276 and causes the actuation lever 220 to reset to its locked (i.e. upward) position.

The shoulder and elbow joints 214,216 can be simultaneously unlocked by engaging the second actuation lever 222 in a downward direction. When the second actuation lever 222 is engaged in a downward direction, the linkage 280 within the housing of the second armature 210 rotates upwardly, applying a pivoting force on two lever arms 282, 284 in mechanical communication with the elbow joint 216. The pivoting of the linkage 280, for example, causes a fist linkage 282 to rotate and disengage from the lock lever plate 236 within the elbow joint 216. The pivoting of the linkage 280 also causes a second linkage 284 to translate downwardly, which, in turn, applies a downward force to another linkage 286 that causes the linkage 286 to pivot. When this occurs, the linkage 286 applies a force on another set of lever arms 288,290 causing the shoulder joint 214 to simultaneously disengage and unlock in a manner similar to the elbow joint 216. In this position, the armatures 208,210 can be repositioned to another locked setting. Once locked into position, the spring force from a leaf spring 292 causes the actuation lever 222 to move upwardly back to its locked position.

Having thus described the several embodiments of the present invention, those of skill in the art will readily appreciate that other embodiments may be made and used which fall within the scope of the claims attached hereto. It will be understood that this disclosure is, in many respects, only illustrative. Changes can be made with respect to various elements described herein without exceeding the scope of the invention.

What is claimed is:

1. A positioning apparatus for supporting one or more objects adjacent to a mounting device, the positioning apparatus comprising:

a base unit;

at least one armature defining an extension of the positioning apparatus;

at least one rotatable joint adapted to permit movement of said at least one armature relative to the base unit;

at least one actuation lever operatively coupled to said at least one joint and actuatable between a first position and a second position;

a platform adapted to support said one or more objects;

wherein actuation of said at least one actuation lever causes one or more of said at least one joint to simultaneously actuate from a locked position to an unlocked position;

a seat including a plurality of guide tabs defining a number of grooves;

a bucket actuatable between said locked position and said unlocked position, the bucket including a number of tabs each adapted to engage a corresponding groove of the seat when the bucket is in said locked bucket position, and adapted to move relative to the grooves and permit movement of the joint when the bucket is in said unlocked position; and a lock-out member adapted to selectively engage the seat grooves when the bucket is in said unlocked position and the joint is rotated.

2. The positioning apparatus of claim 1, wherein the base unit includes a tube clamp bushing.

3. The positioning apparatus of claim 1, wherein said at least one armature comprises a single armature.

4. The positioning apparatus of claim 1, wherein said at least one armature comprises a plurality of armatures.

5. The positioning apparatus of claim 4, wherein each of said plurality of armatures has at least one degree of freedom of movement relative to the base unit.

6. The positioning apparatus of claim 4, wherein said plurality of armatures includes:

a first armature defining a first extension of the apparatus; and a second armature defining a second extension of the apparatus.

7. The positioning apparatus of claim 6, wherein said at least one joint includes:

a first rotatable joint adapted to permit movement of the first armature relative to the base unit; and a second rotatable joint adapted to permit movement of the second armature relative to the first armature.

8. The positioning apparatus of claim 7, further comprising a third rotatable joint adapted to permit movement of the platform relative to the second armature.

9. The positioning apparatus of claim 8, wherein said at least one actuation lever includes:

a first actuation lever operatively coupled to the first and second joints and actuatable between said first position and said second position for simultaneously unlocking the first and second joints; and a second actuation lever operatively coupled to the third joint and actuatable between said first position and said second position for unlocking the third joint.

10. The positioning apparatus of claim 1, further comprising a means for setting one or more locked positions on each joint to limit or prevent rotational movement of the joint, the one or more locked positions adapted to prevent the lock-out member from engaging one or more of the seat grooves.

11. The positioning apparatus of claim 10, wherein said means for setting one or more locked positions on each joint includes one or more twistlets.

12. The positioning apparatus of claim 1, wherein the lock-out member is spring biased towards the groove.

13. The positioning apparatus of claim 1, wherein the bucket further includes:

an inset portion adapted to receive the lock-out member; and a scanning member adapted to scan for one or more locked positions set on the joint.

14. The positioning apparatus of claim 13, wherein the scanning member includes a tooth.

15. The positioning apparatus of claim 13, wherein the inset portion includes:

a first inset section extending inwardly from an outer periphery of the bucket and having a first depth; and a second inset section extending inwardly from the first section and having a second depth slightly deeper than the first depth of the first inset section.

16. The positioning apparatus of claim 15, wherein, when the bucket is in the unlocked position, the lock-out member can be configured to move to said first position aligned with the second inset section of the bucket.

17. The positioning apparatus of claim 16, wherein, during rotation of the joint, the lock-out member can be configured to move to said second position for each locked position set on the joint.

18. The positioning apparatus of claim 1, further comprising a linkage mechanism adapted to translate motion from at least one actuation lever to the bucket handle of each joint.

19. The positioning apparatus of claim 1, wherein each joint further includes a friction bearing.

20. The positioning apparatus of claim 1, further comprising a spring loaded bucket handle adapted to bias the bucket against the seat.

21. The positioning apparatus of claim 1, wherein said platform is a tiltable platform including a friction hinge.

22. The positioning apparatus of claim 21, wherein the torque resistance of the friction hinge is variable.

23. A positioning apparatus for supporting one or more objects adjacent to a mounting device, the positioning apparatus comprising:

a base unit including a means for mounting the positioning apparatus to the mounting device;

a first armature defining a first extension of the positioning apparatus;

a first rotatable joint operatively coupled to the first armature and adapted to permit rotational movement of the first armature relative to the base unit;

a second armature defining a second extension of the apparatus;

a second rotatable joint operatively coupled to the second armature and adapted to permit rotational movement of the second armature relative to the first armature;

at least one actuation lever operatively coupled to the first and second joint and actuatable between a first position and a second position;

a platform adapted to support said one or more objects;

wherein actuation of the at least one lever causes each of the first and second joints to simultaneously actuate from a locked position to an unlocked position;

a seat including a plurality of guide tabs defining a number of grooves;

a bucket actuatable between said locked position and said unlocked position, the bucket including a number of tabs each adapted to engage a corresponding groove of the seat when the bucket is in said locked bucket position, and adapted to move relative to the grooves and permit movement of the joint when the bucket is in said unlocked position; and a lock-out member adapted to selectively engage the seat grooves when the bucket is in said unlocked position and the joint is rotated.

24. The positioning apparatus of claim 23, wherein said means for mounting the apparatus to the mounting device includes an adjustable tube clamp bushing.

25. The positioning apparatus of claim 23, wherein each of said plurality of armatures has at least one degree of freedom of movement relative to the base unit.

26. The positioning apparatus of claim 23, further comprising a third rotatable joint adapted to permit movement of the platform relative to the second armature.

27. The positioning apparatus of claim 25, wherein said at least one actuation lever includes:

a first actuation lever operatively coupled to the first and second joints and actuatable between said first position and said second position for simultaneously unlocking the first and second joints; and a second actuation lever operatively coupled to the third joint and actuatable between said first position and said second position for unlocking the third joint.

28. The positioning apparatus of claim 23, further comprising a means for setting one or more locked positions on each joint to limit or prevent rotational movement of the joint, the one or more locked positions adapted to prevent the lock-out member from engaging one or more of the seat grooves.

29. The positioning apparatus of claim 28, wherein said means for setting one or more locked positions on each joint includes one or more twistlets.

30. The positioning apparatus of claim 23, wherein the lock-out member is spring biased towards the groove.

31. The positioning apparatus of claim 23, wherein the bucket further includes:

an inset portion adapted to receive the lock-out member; and a scanning member adapted to scan for one or more locked positions set on the joint.

32. The positioning apparatus of claim 31, wherein the scanning member includes a tooth.

33. The positioning apparatus of claim 31, wherein the inset portion includes:

a first inset section extending inwardly from an outer periphery of the bucket and having a first depth; and a second inset section extending inwardly from the first section and having a second depth slightly deeper than the first depth of the first inset section.

34. The positioning apparatus of claim 33, wherein, when the bucket is in the unlocked position, the lock-out member can be configured to move to said first position aligned with the second inset section of the bucket.

35. The positioning apparatus of claim 34, wherein, during rotation of the joint, the lock-out member can be configured to move to said second position for each locked position set on the joint.

36. The positioning apparatus of claim 23, further comprising a linkage mechanism adapted to translate motion from at least one actuation lever to the bucket handle of each joint.

37. The positioning apparatus of claim 23, wherein each joint further includes a friction bearing.

38. The positioning apparatus of claim 23, further comprising a spring loaded bucket handle adapted to bias the bucket against the seat.

39. The positioning apparatus of claim 23, wherein said platform is a tiltable platform.

40. The positioning apparatus of claim 39, wherein a torque resistance of the tiltable platform varies.

* * * * *